US012222152B2

(12) United States Patent
Park et al.

(10) Patent No.: US 12,222,152 B2
(45) Date of Patent: Feb. 11, 2025

(54) REFRIGERATOR

(71) Applicant: LG Electronics Inc., Seoul (KR)

(72) Inventors: Dohyun Park, Seoul (KR); Haewon Seo, Seoul (KR); Sunghee Kang, Seoul (KR); Yongbum Cho, Seoul (KR); Kihwang Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/787,136

(22) PCT Filed: Oct. 26, 2021

(86) PCT No.: PCT/KR2021/015136

§ 371 (c)(1),
(2) Date: Jun. 17, 2022

(87) PCT Pub. No.: WO2022/124568

PCT Pub. Date: Jun. 16, 2022

(65) Prior Publication Data

US 2023/0332819 A1 Oct. 19, 2023

(30) Foreign Application Priority Data

Dec. 10, 2020 (KR) ..... 10-2020-0172259

(51) Int. Cl.
*F25D 17/06* (2006.01)
*F25D 17/08* (2006.01)

(52) U.S. Cl.
CPC ..... *F25D 17/065* (2013.01); *F25D 17/08* (2013.01); *F25D 2317/067* (2013.01)

(58) Field of Classification Search
CPC .. F25D 17/065; F25D 17/08; F25D 2317/067; F25D 17/062; F25D 23/066;
(Continued)

(56) References Cited

U.S. PATENT DOCUMENTS 2,994,207 A * 8/1961 Preotle ..... F25D 21/008 62/155
3,992,171 A * 11/1976 Jenewein ..... F25D 17/065 62/419

(Continued)

FOREIGN PATENT DOCUMENTS

CN 1138955 C 2/2004
CN 109990532 A 7/2019

(Continued)

OTHER PUBLICATIONS

KR-0165009-B1, machine translation (Year: 2024).*
Office Action of Australian Patent Office in Appl'n 2021396892, dated Jul. 17, 2023.

*Primary Examiner* — Eric S Ruppert
*Assistant Examiner* — Kirstin U Oswald
(74) *Attorney, Agent, or Firm* — Bryan Cave Leighton Paisner LLP

(57) ABSTRACT

A refrigerator includes a cabinet, an evaporator, a freezer compartment grille assembly, a refrigerating compartment grille assembly, a refrigerating compartment door, and a cold air duct for door cooling. Particularly, the cold air duct for door cooling is located to be as apart as possible from a hot line or an outer casing so as to reduce heat loss and power consumption due to the heat loss.

20 Claims, 29 Drawing Sheets

(58) Field of Classification Search
CPC ..... F25D 2317/062; F25D 2317/0666; F25D 21/04; F25D 2317/0664
USPC ..... 62/89
See application file for complete search history.

(56) References Cited

U.S. PATENT DOCUMENTS

| | | | | | |
|---|---|---|---|---|---|
| 5,735,138 | A * | 4/1998 | Park | F25D 17/065 | 62/419 |
| 5,822,998 | A * | 10/1998 | Lim | G05D 23/1917 | 62/186 |
| 5,899,089 | A * | 5/1999 | Kwon | F25D 17/065 | 62/407 |
| 5,960,641 | A * | 10/1999 | Kim | F25D 17/065 | 62/451 |
| 2004/0139763 | A1 * | 7/2004 | Jeong | F25D 17/062 | 62/448 |

FOREIGN PATENT DOCUMENTS

| | | | |
|---|---|---|---|
| JP | H1114225 | A | 1/1999 |
| JP | H-11270952 | A1 * | 10/1999 |
| KR | 0165009 | B1 * | 1/1999 |
| KR | 20000003336 | U | 2/2000 |
| KR | 20-0248925 | Y | 9/2001 |
| KR | 10-2002-0039739 | A | 5/2002 |
| KR | 10-2003-0041588 | A | 5/2003 |
| KR | 10-2003-0042757 | A | 6/2003 |
| KR | 100452983 | B1 | 10/2004 |
| KR | 20110089713 | A | 8/2011 |
| KR | 101821813 | B1 | 3/2018 |
| WO | 2022124568 | A1 | 6/2022 |

* cited by examiner

[Fig. 1]
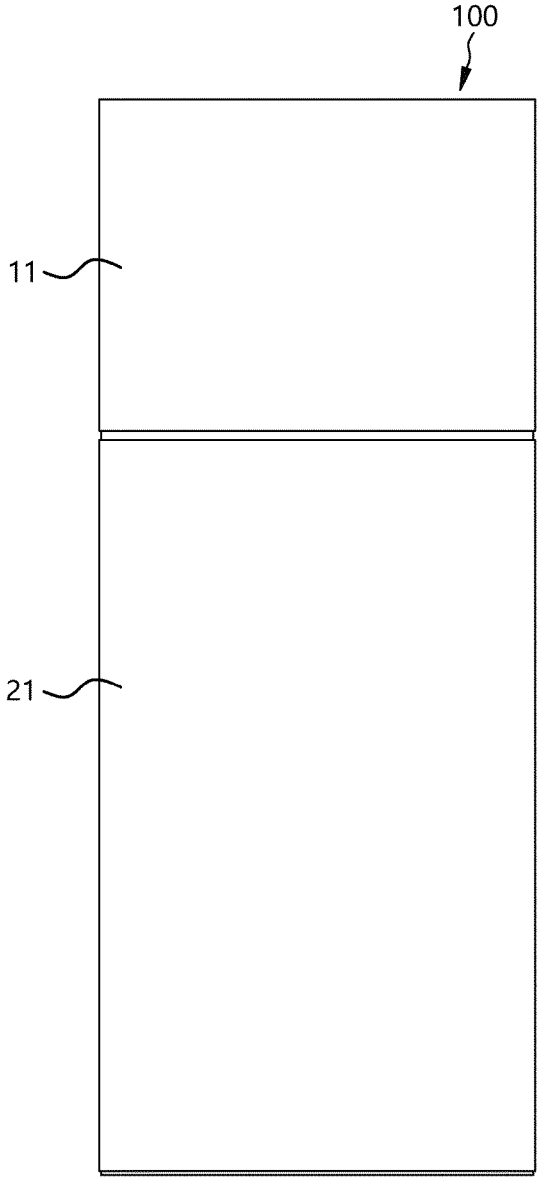

[Fig. 2]
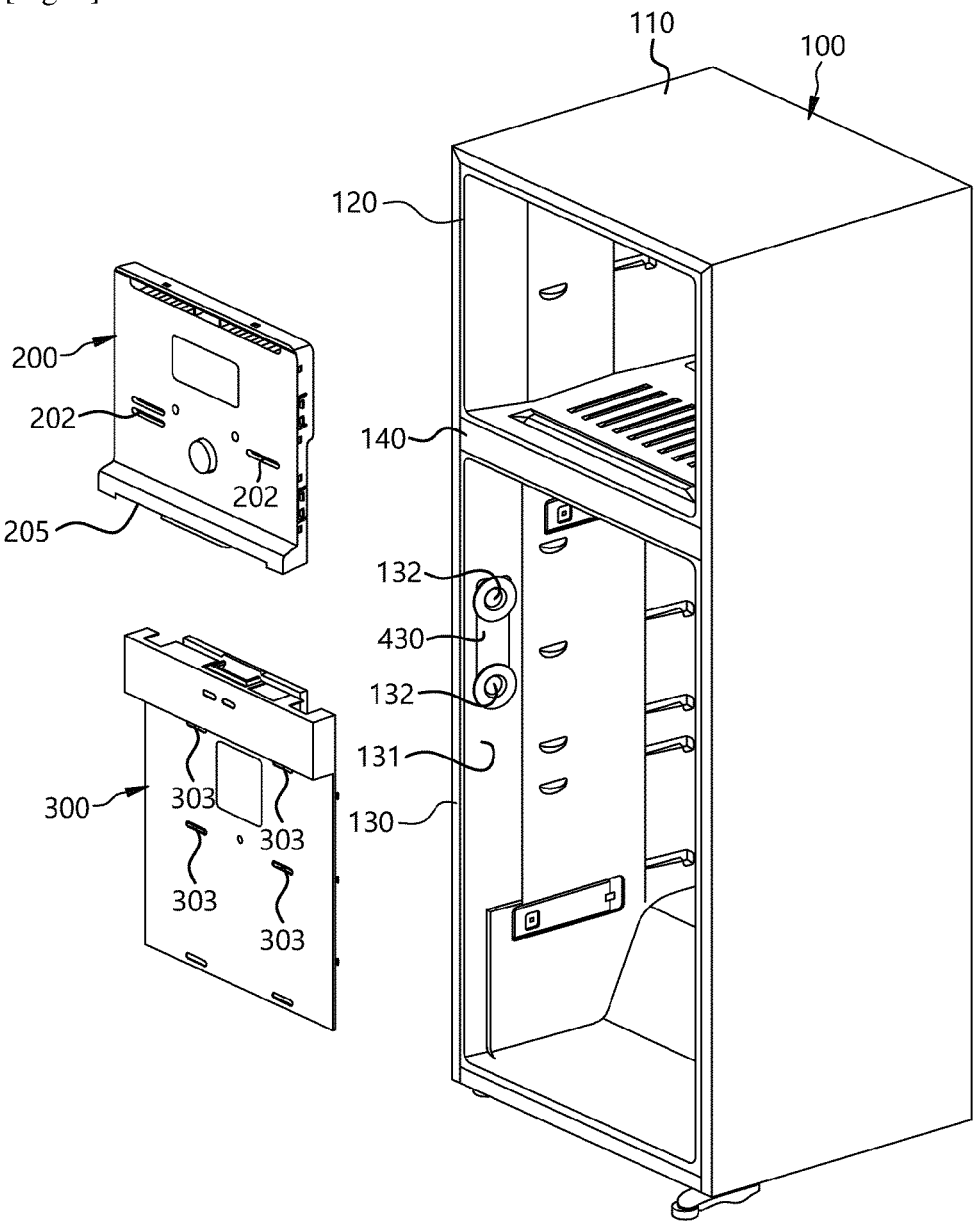

[Fig. 3]
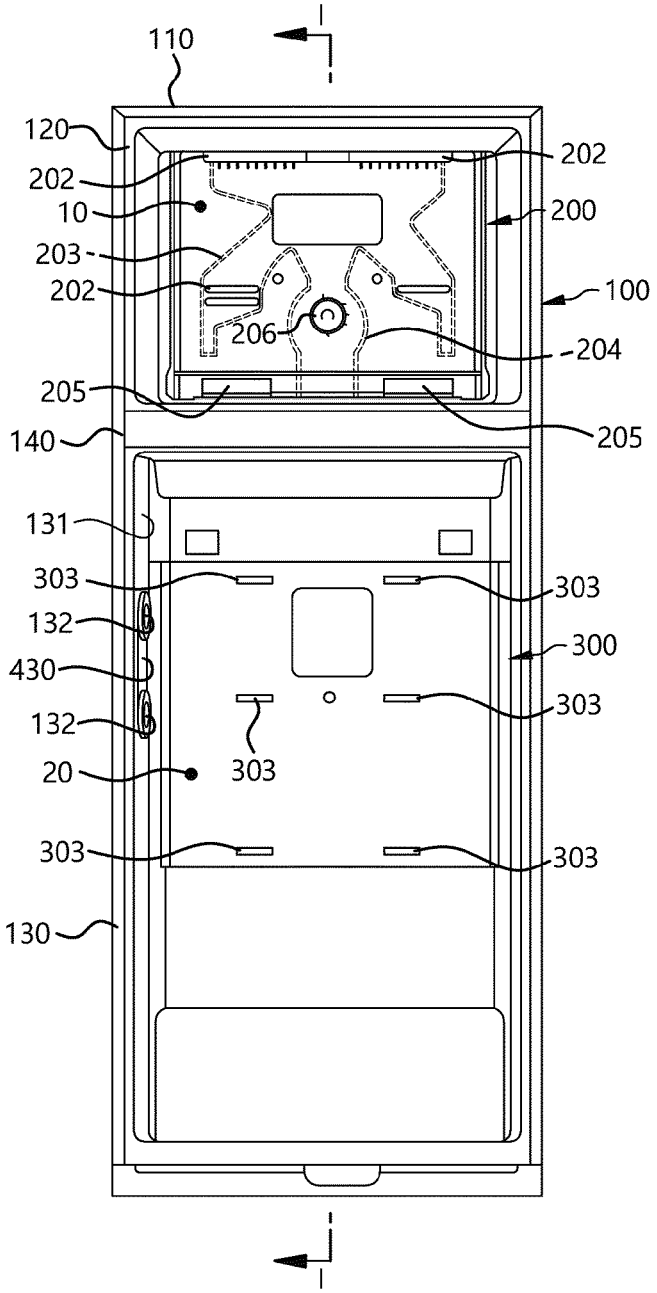

[Fig. 4]
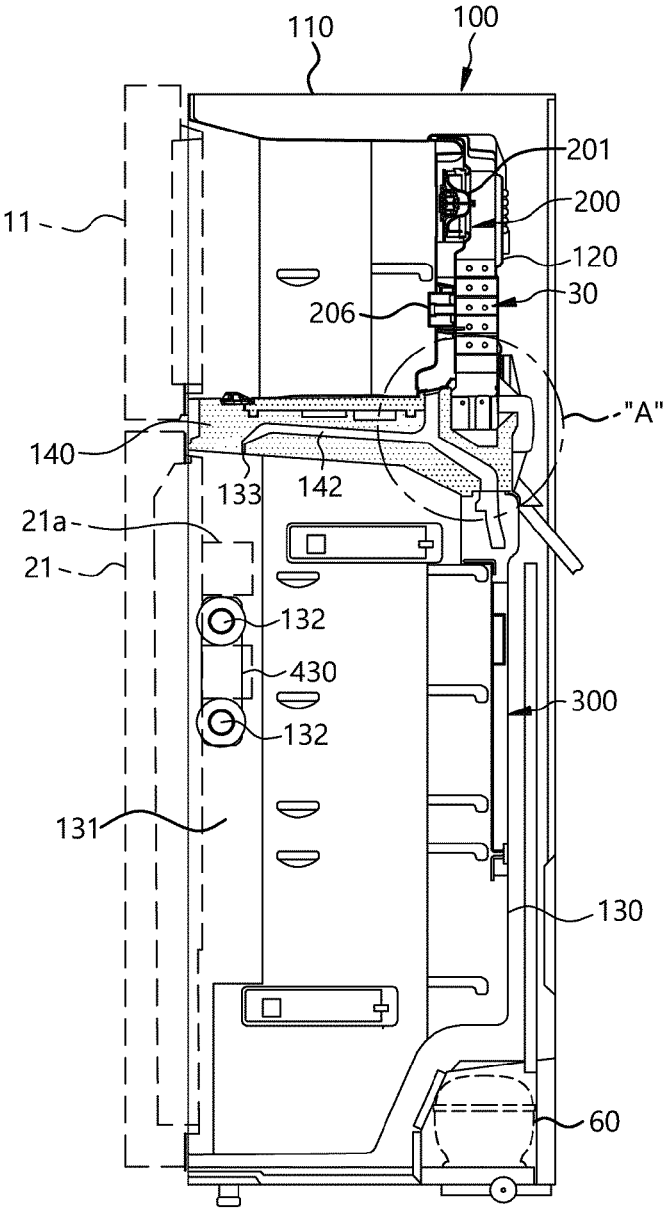

[Fig. 5]
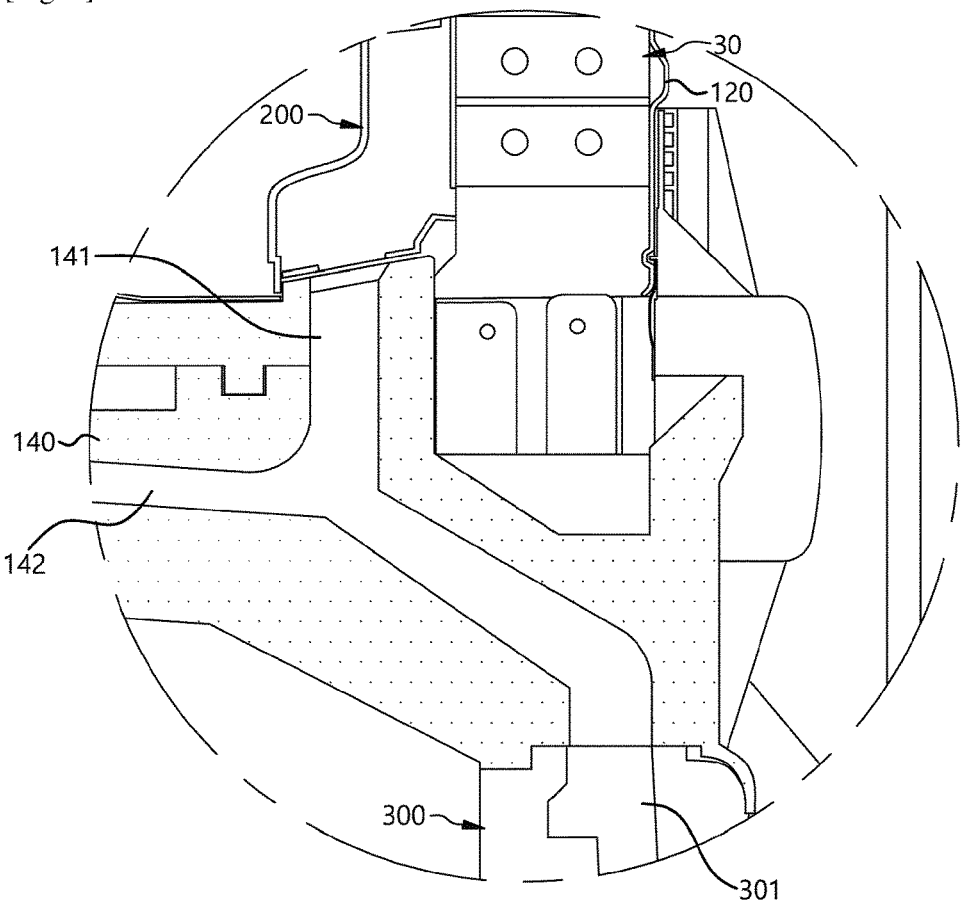
[Fig. 6]
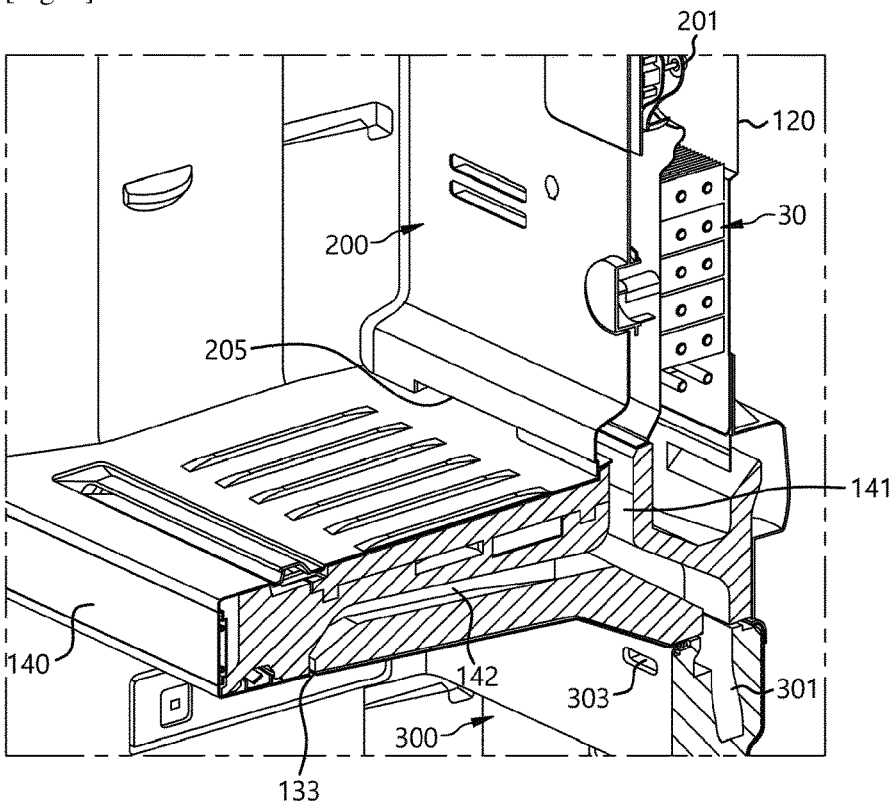

[Fig. 7]
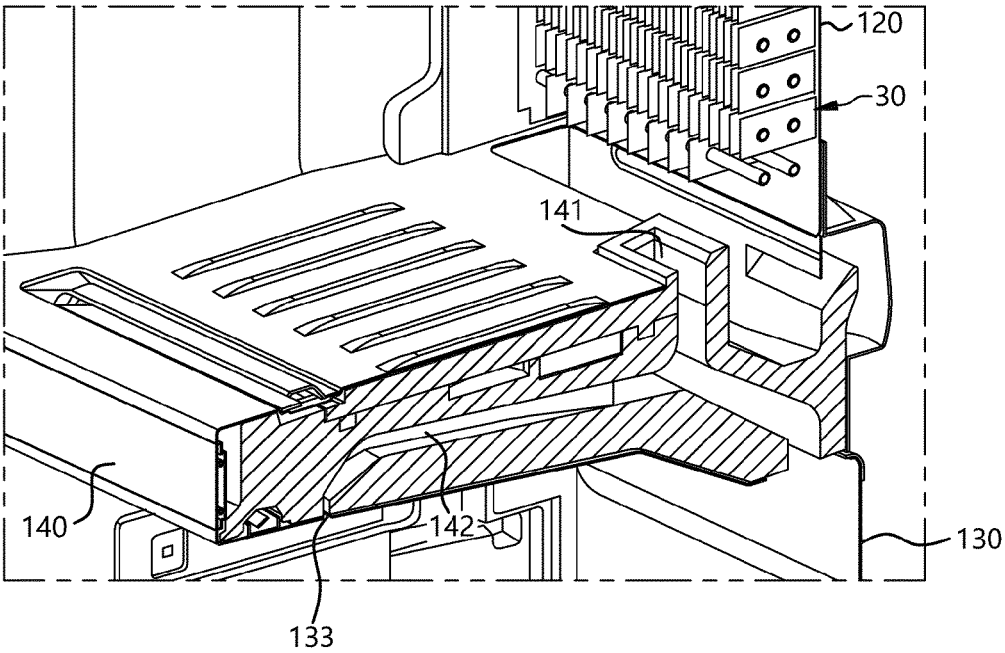
[Fig. 8]
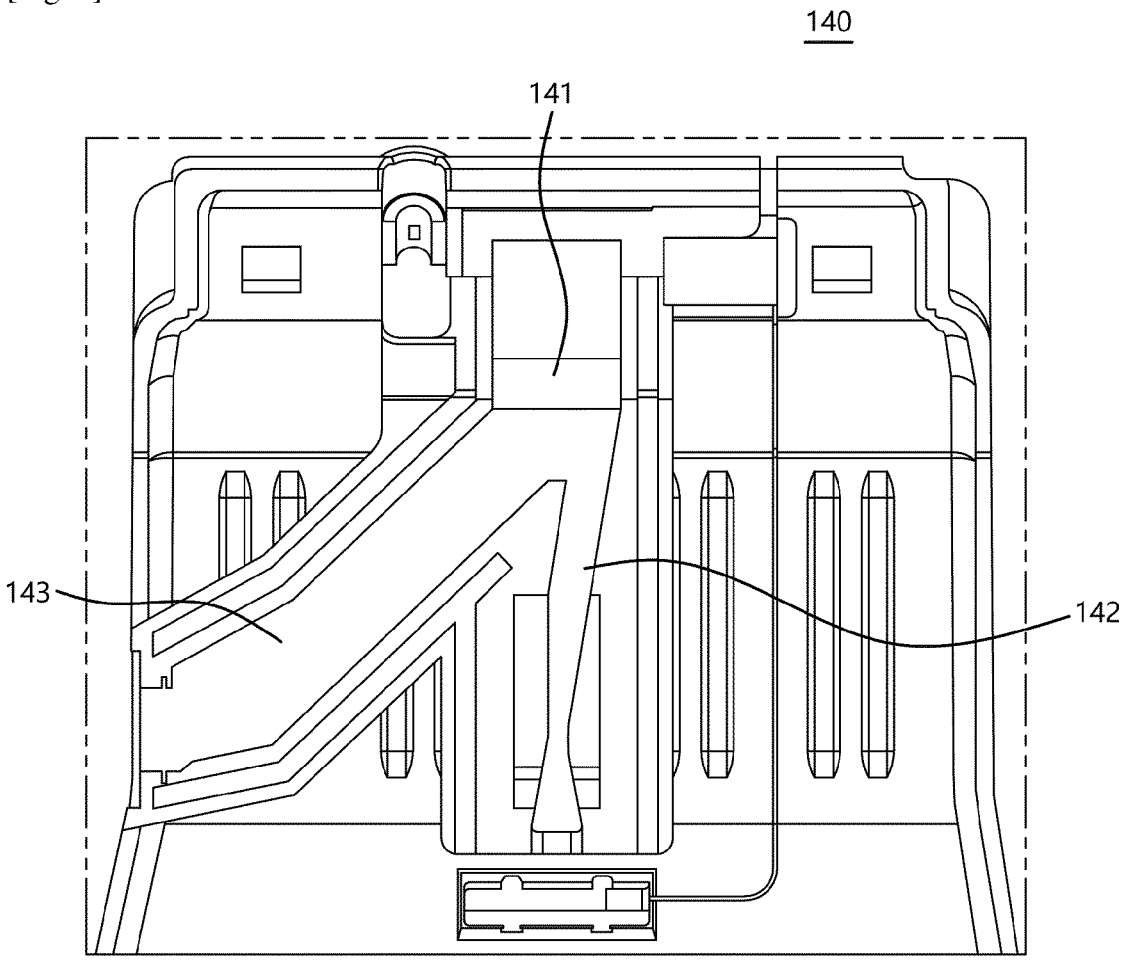

[Fig. 9]
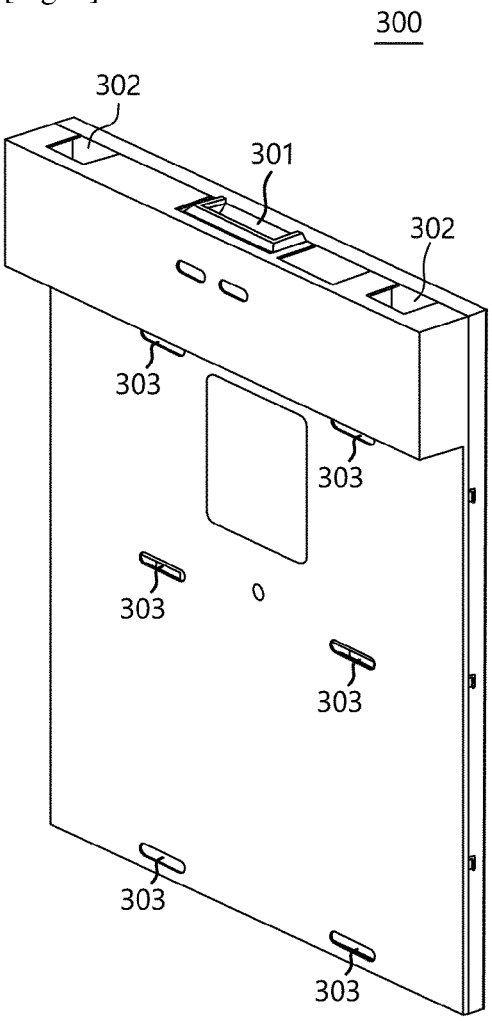

[Fig. 10]
300
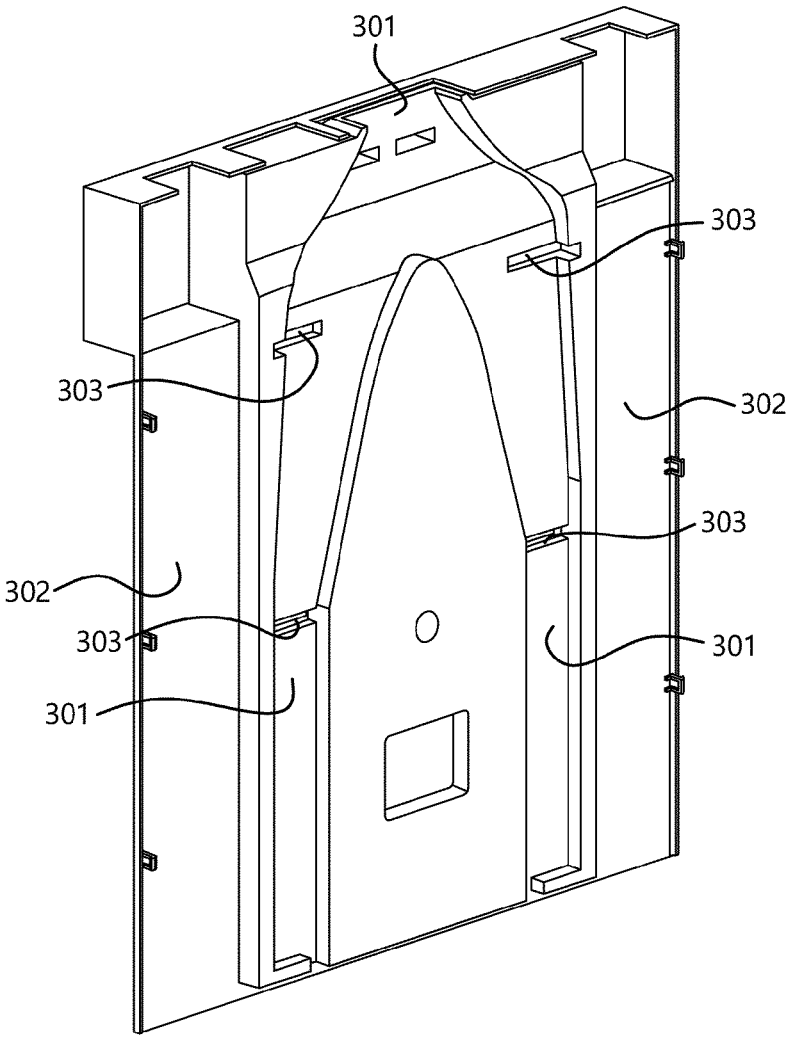

[Fig. 11]
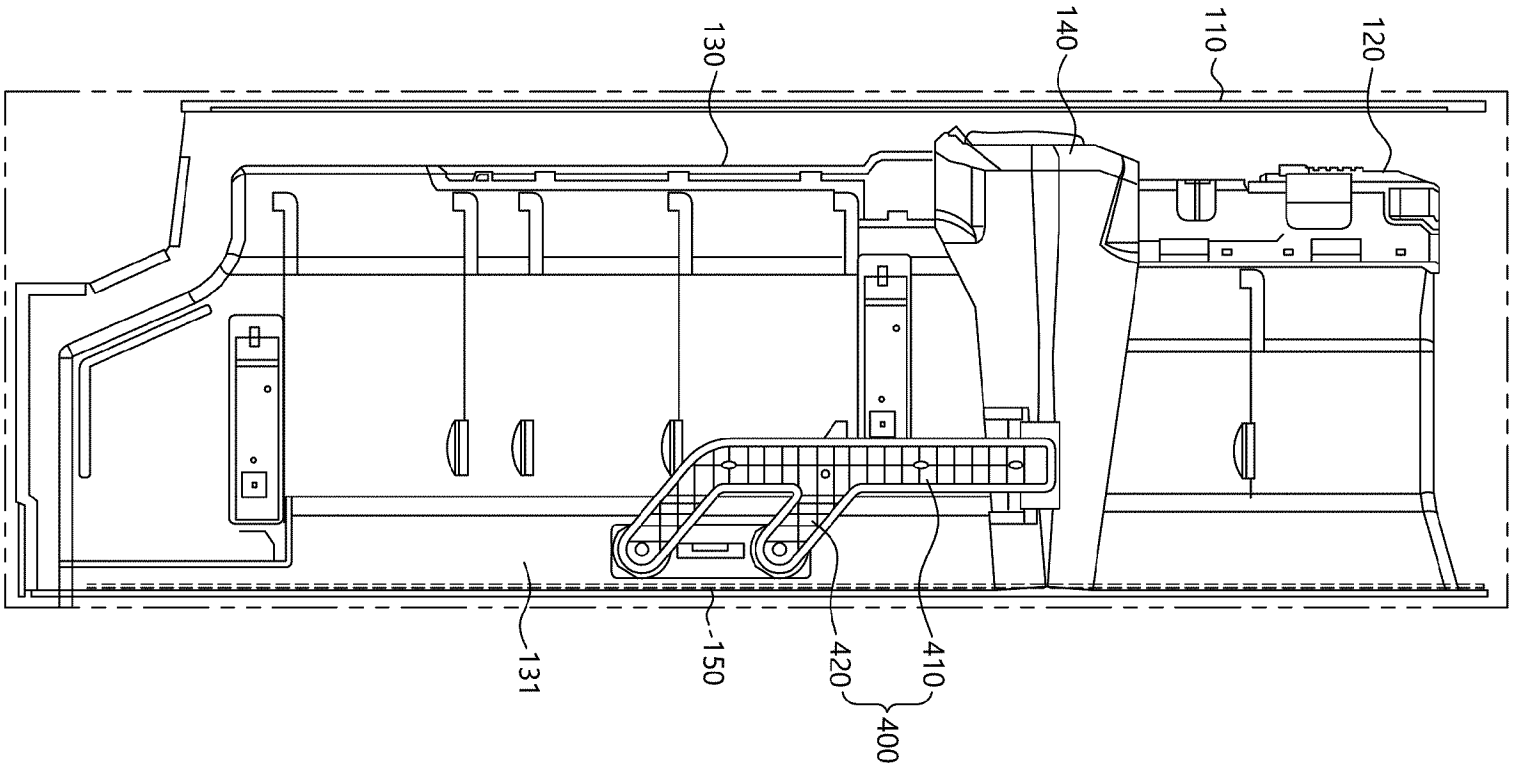

[Fig. 12]
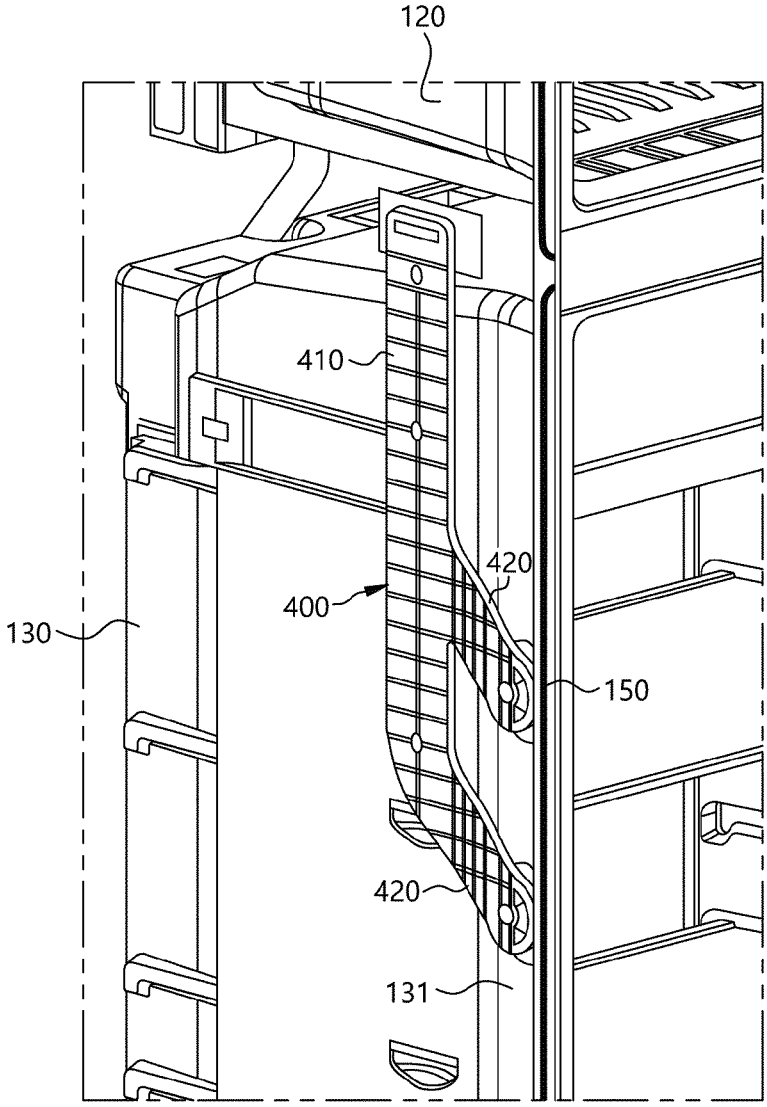

[Fig. 13]
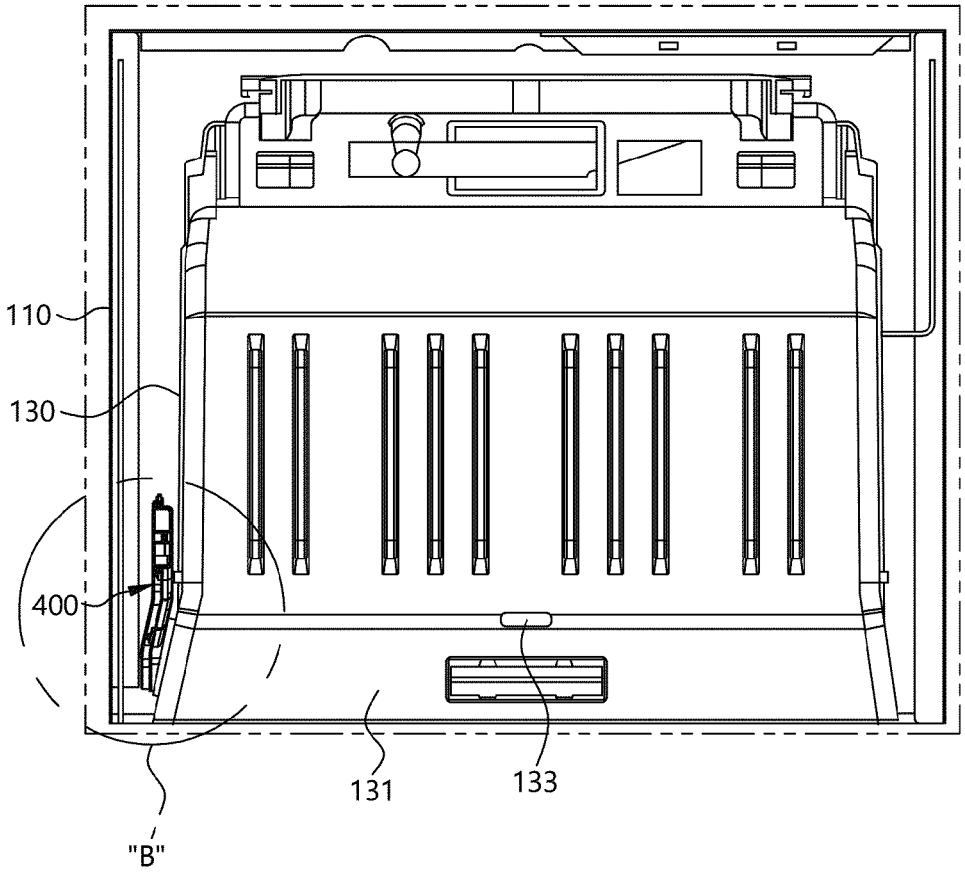

[Fig. 14]
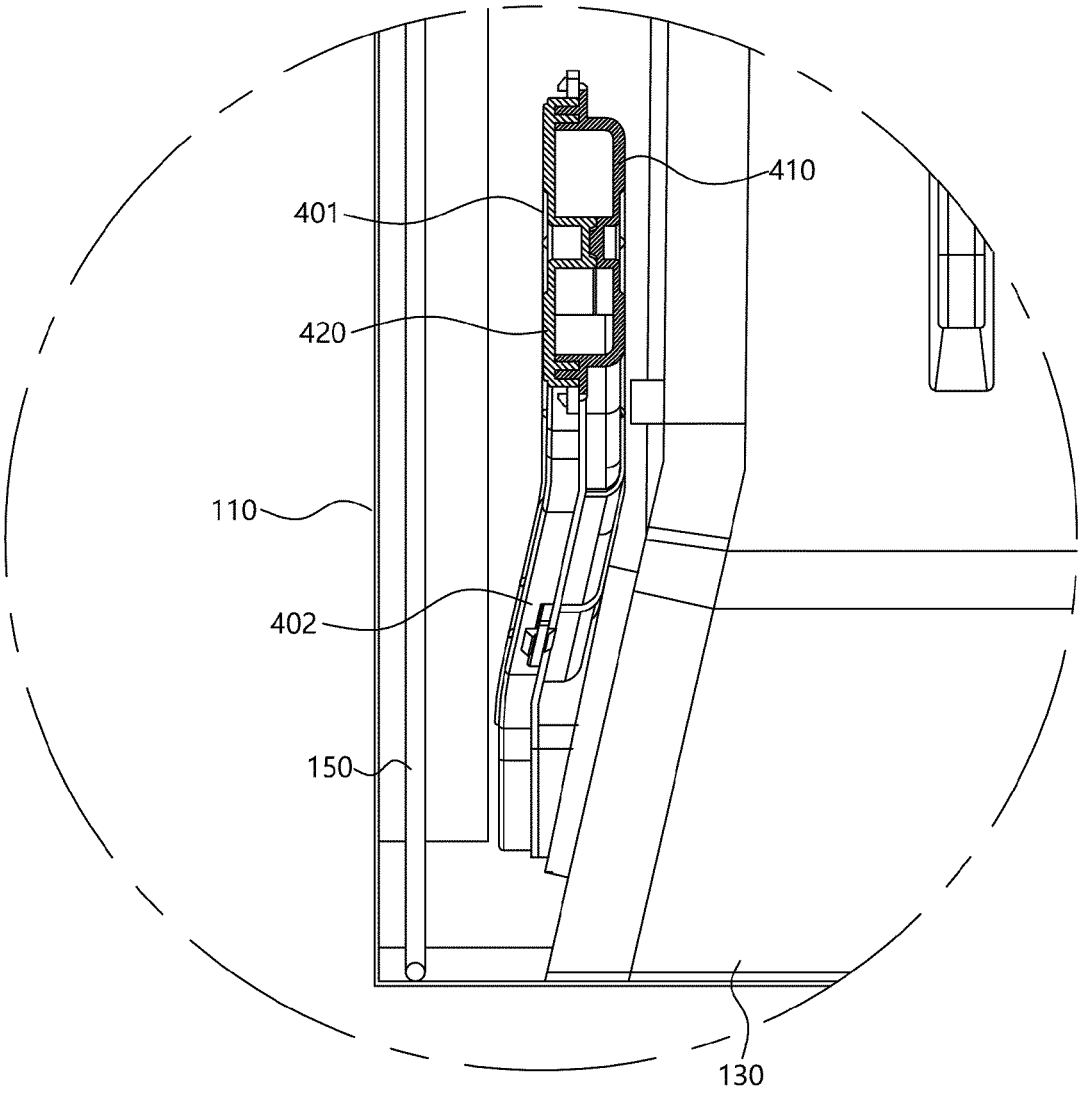

[Fig. 15]
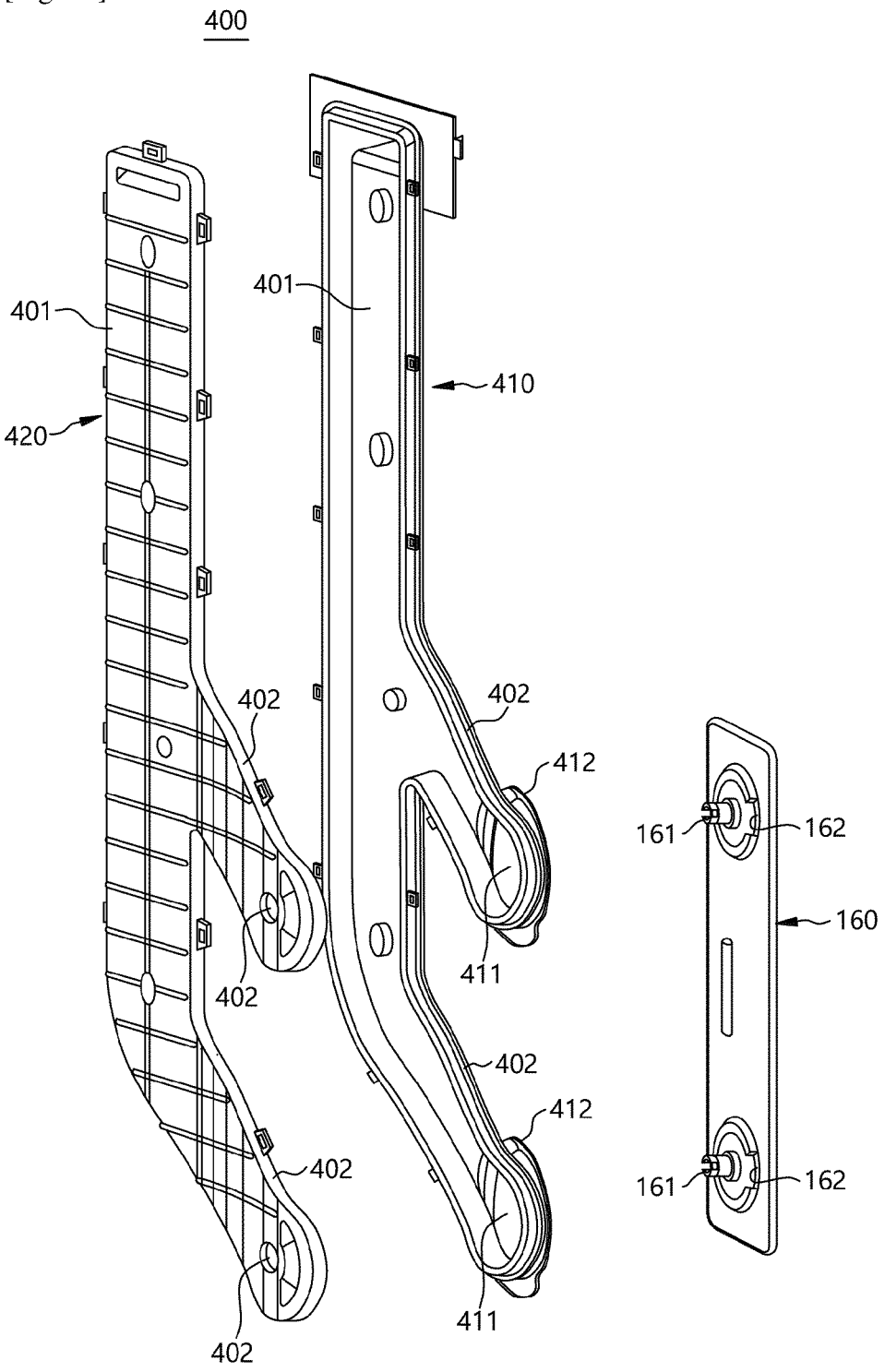

[Fig. 16]
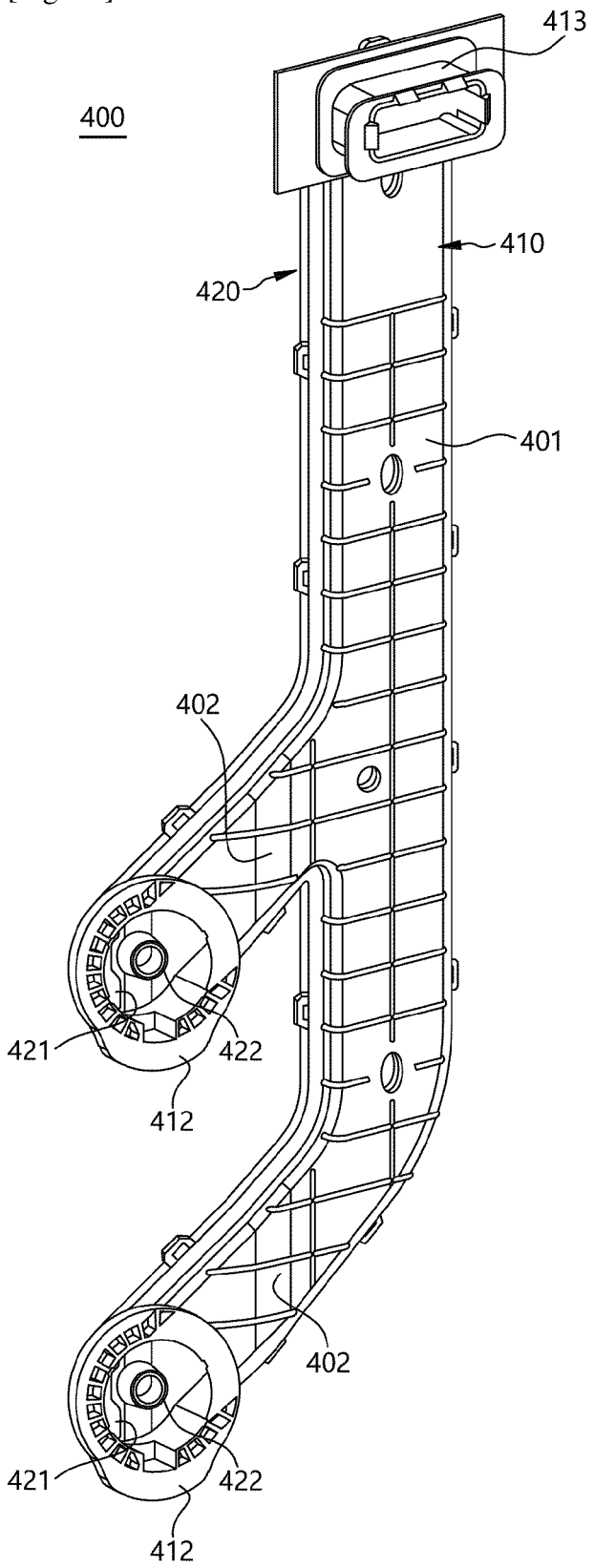

[Fig. 17]
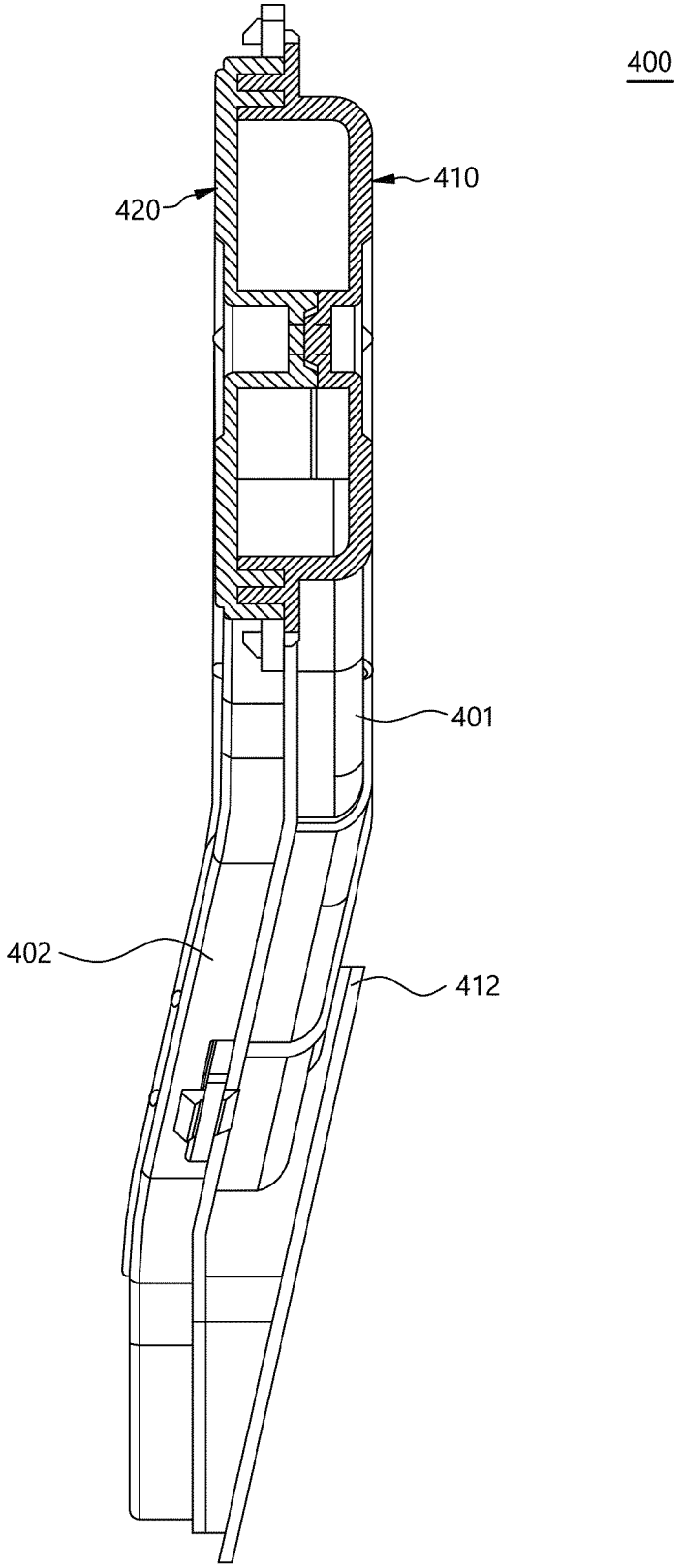

[Fig. 18]
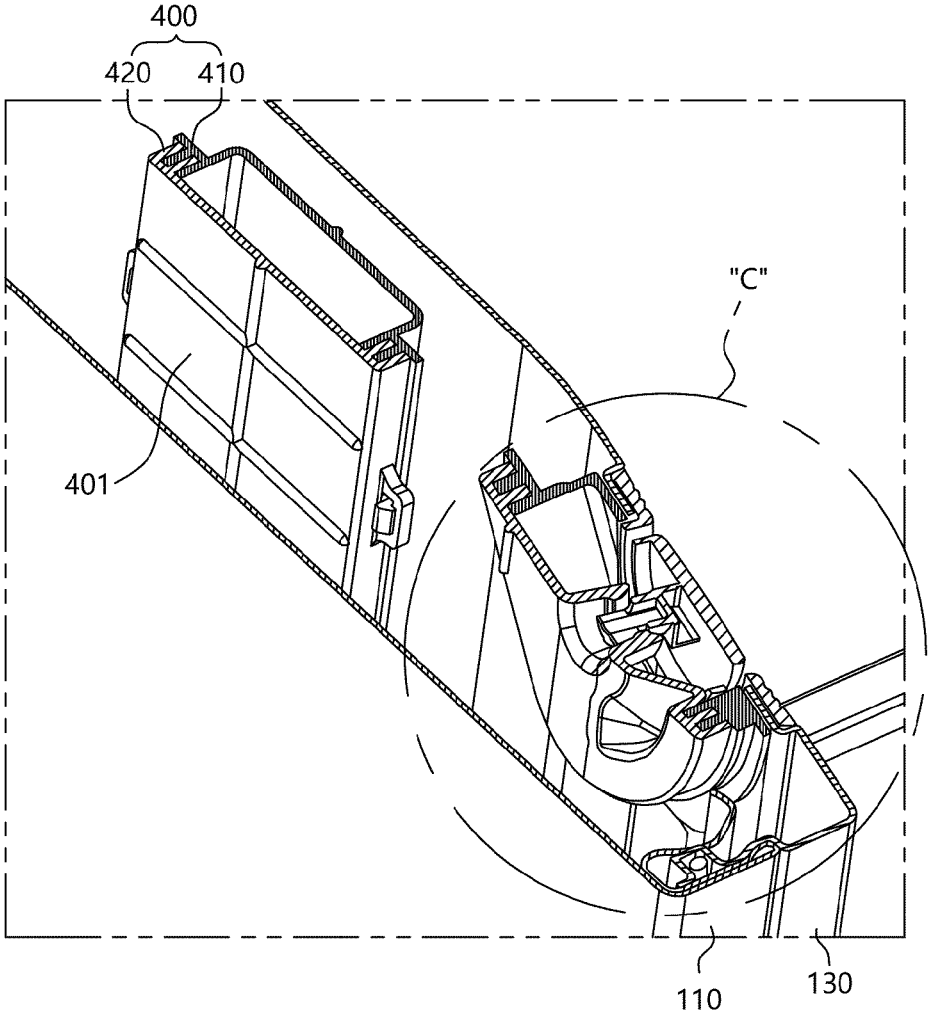

[Fig. 19]
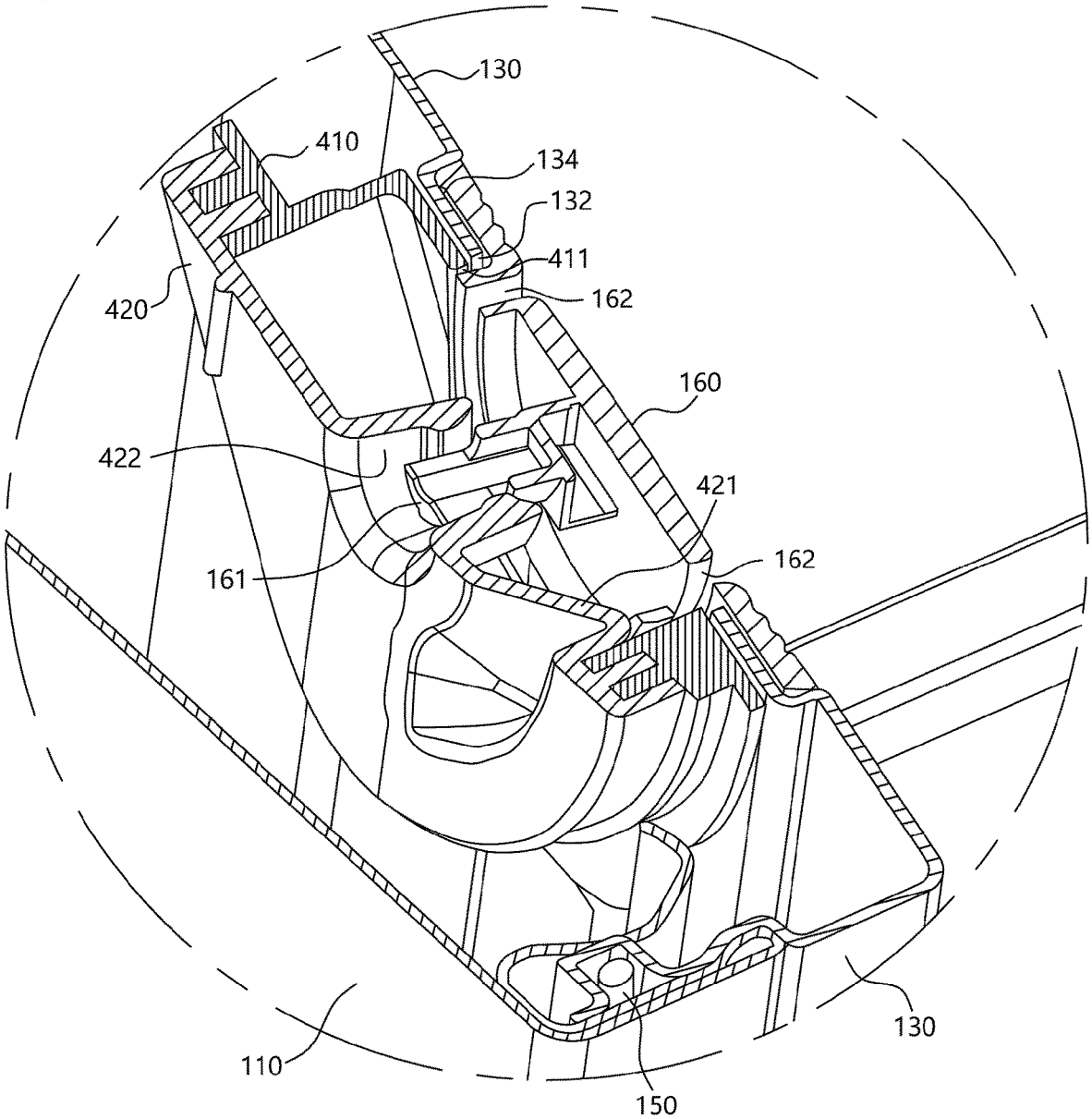

[Fig. 20]
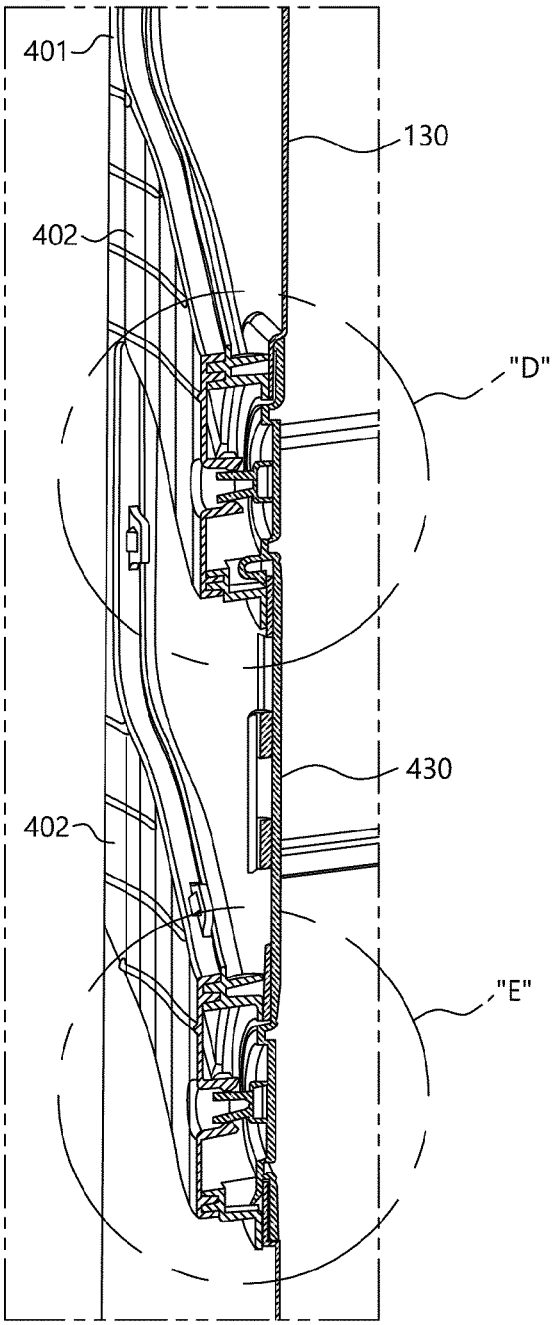

[Fig. 21]
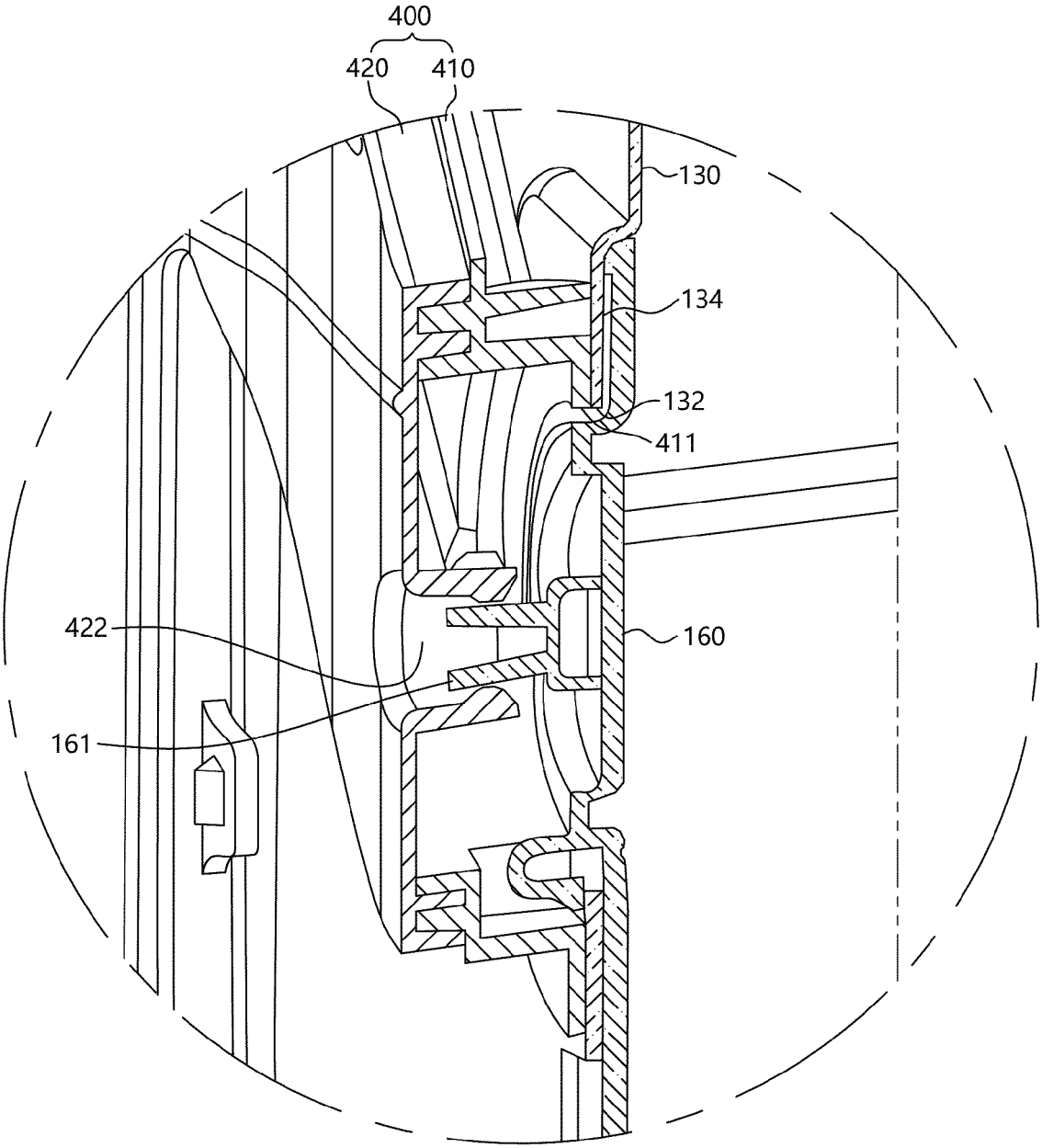

[Fig. 22]
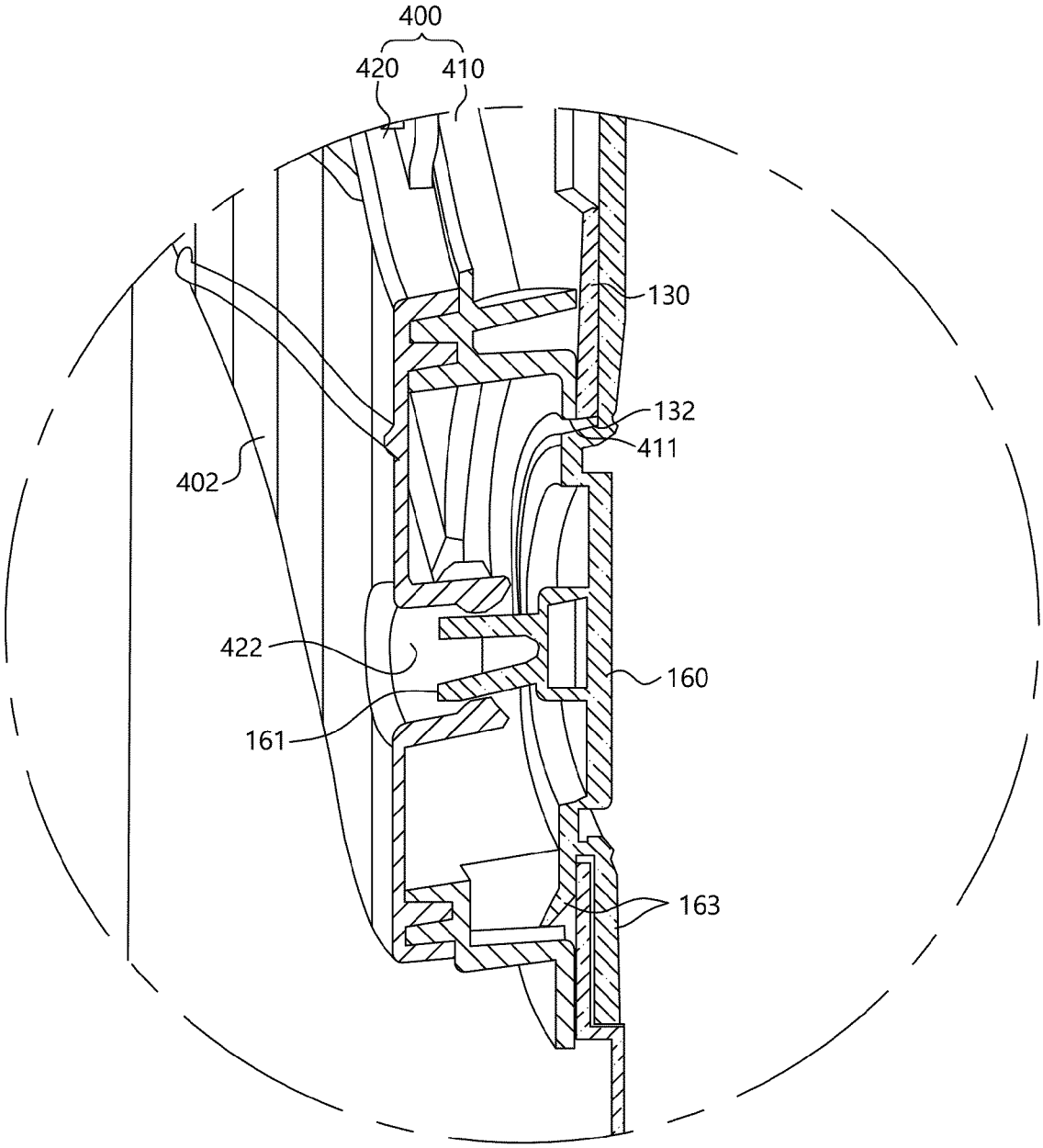

[Fig. 23]
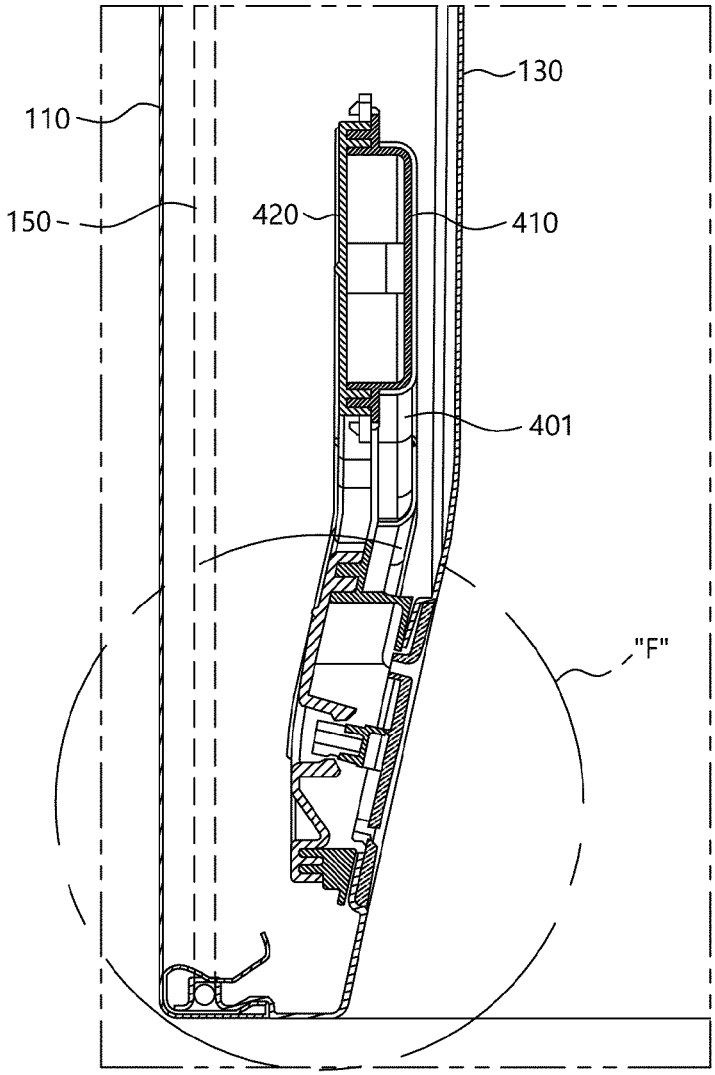

[Fig. 24]
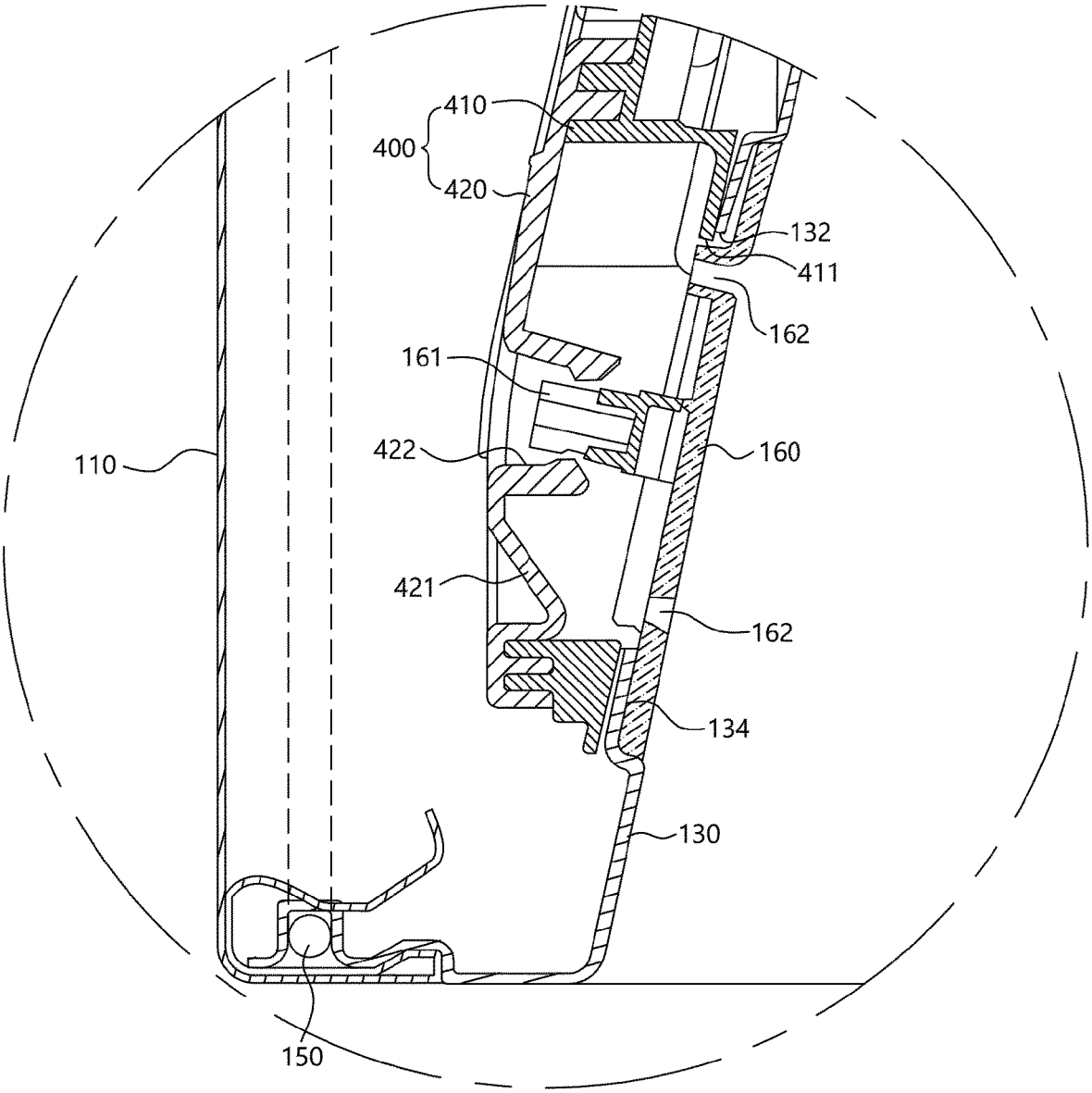

[Fig. 25]
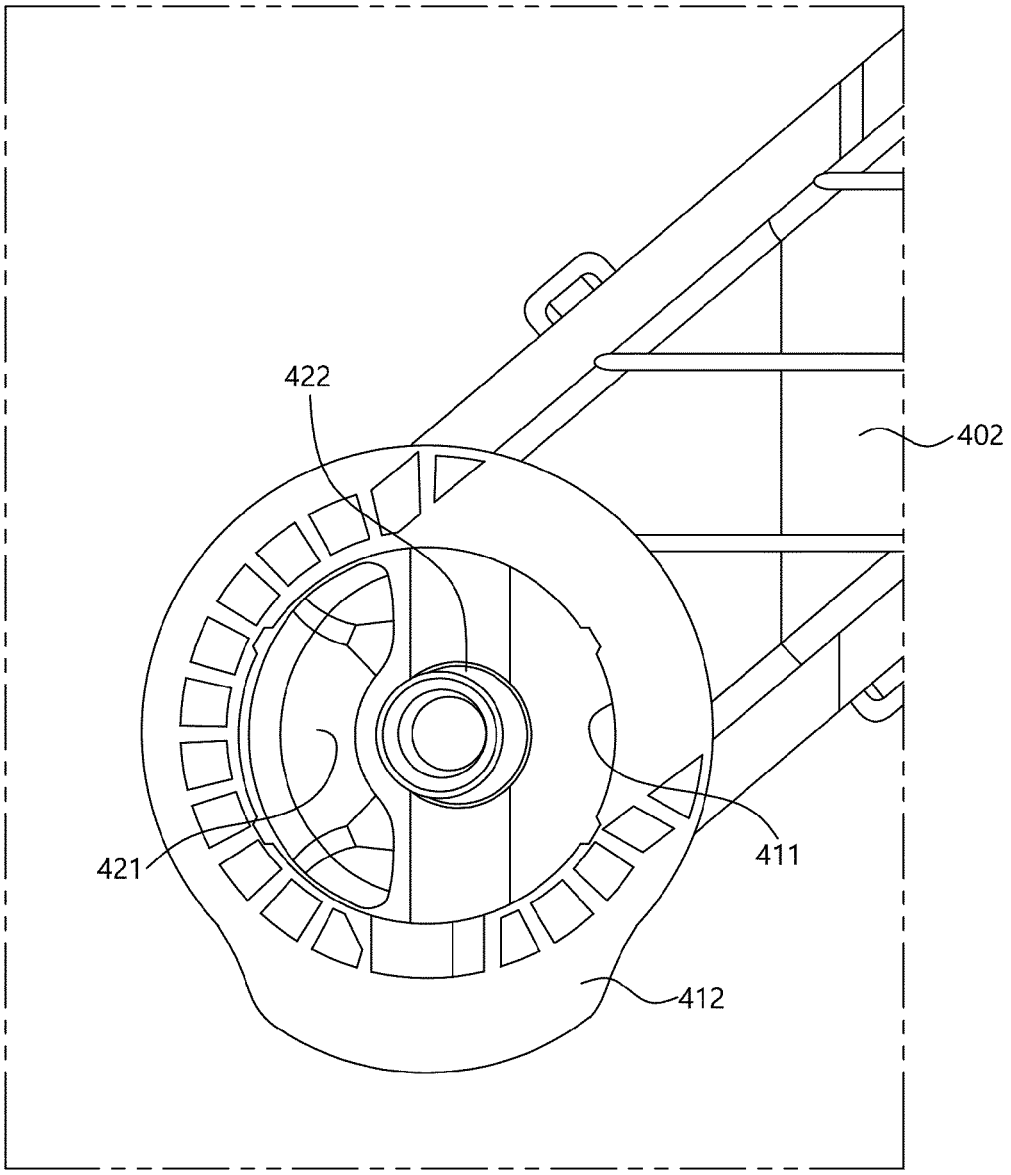

[Fig. 26]
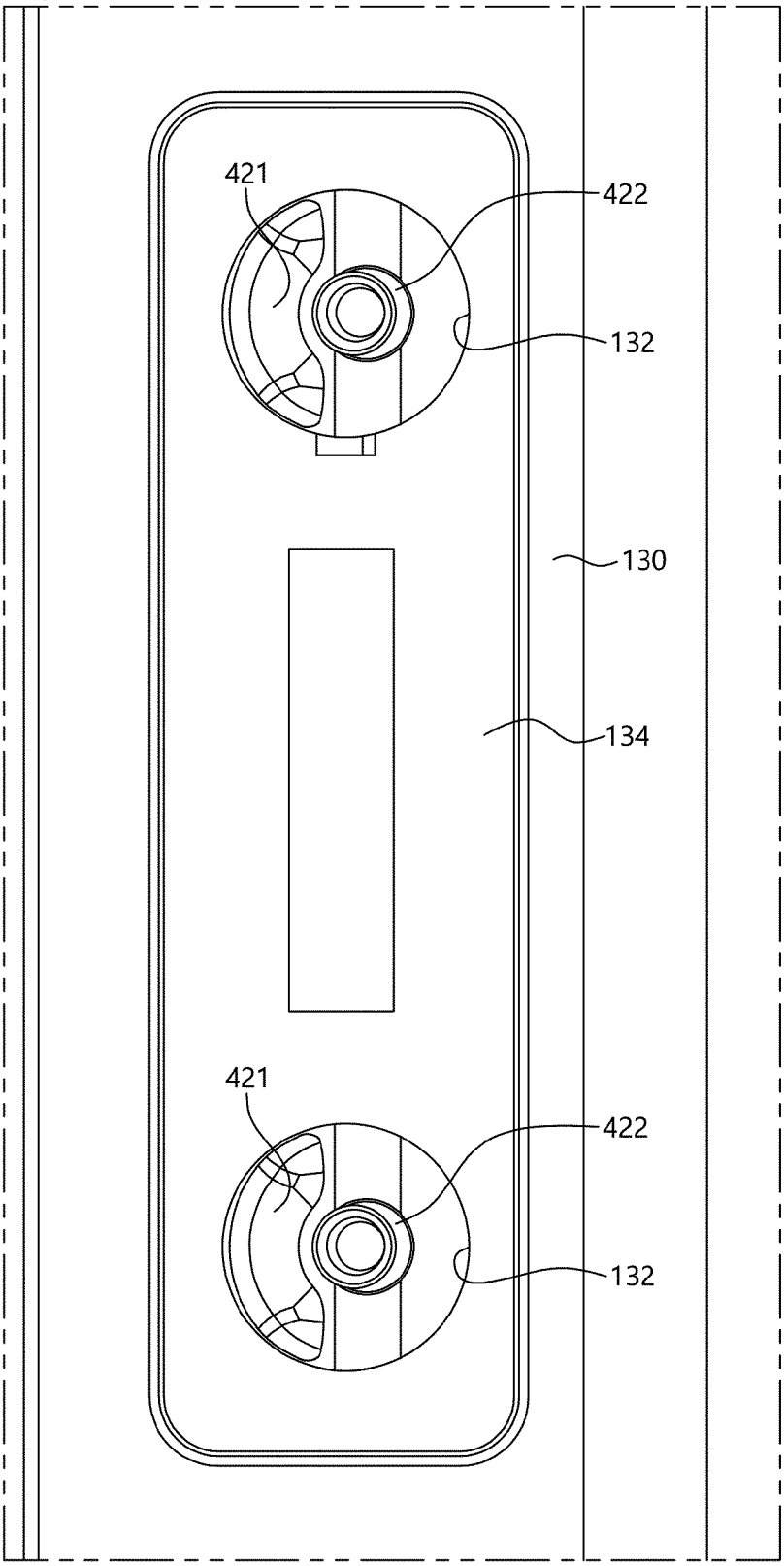

[Fig. 27]
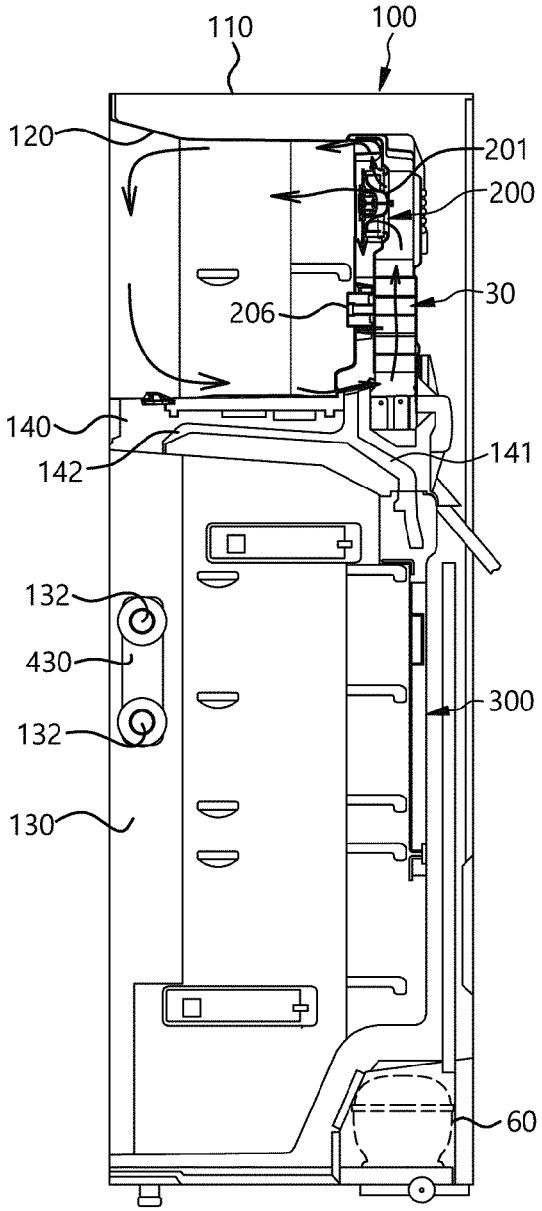

[Fig. 28]
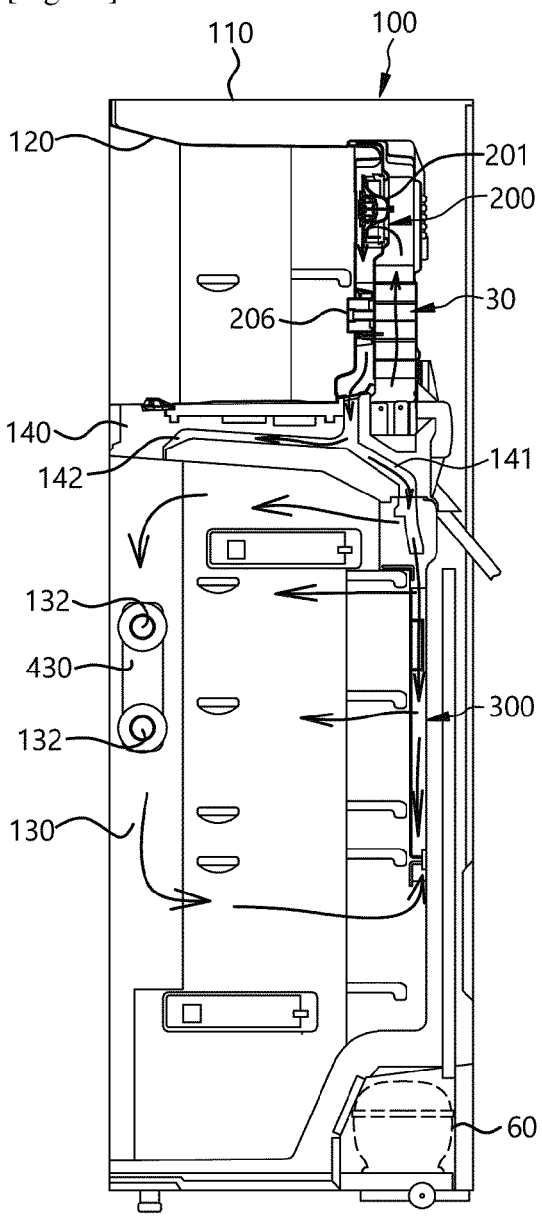

[Fig. 29]
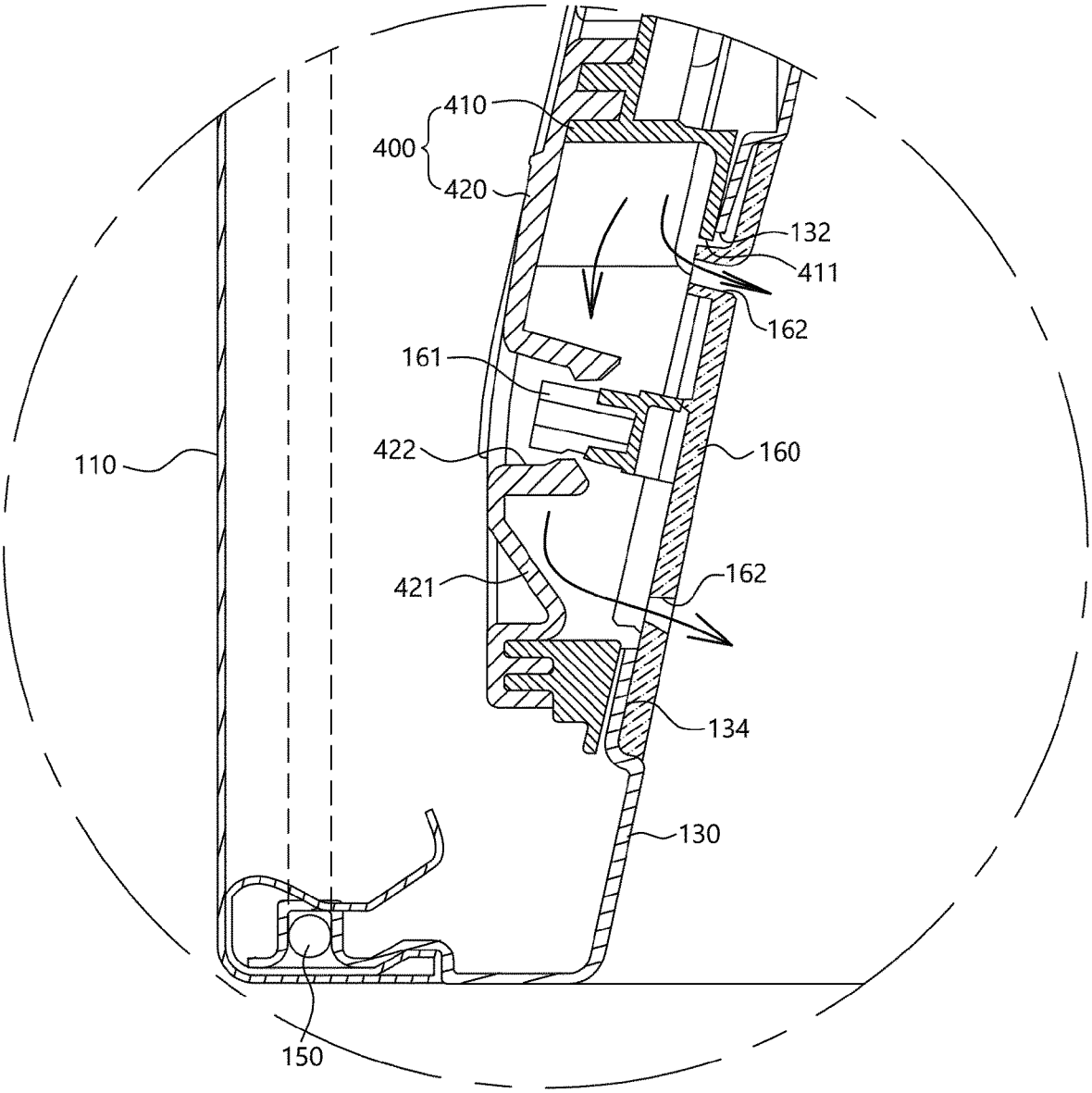

[Fig. 30]
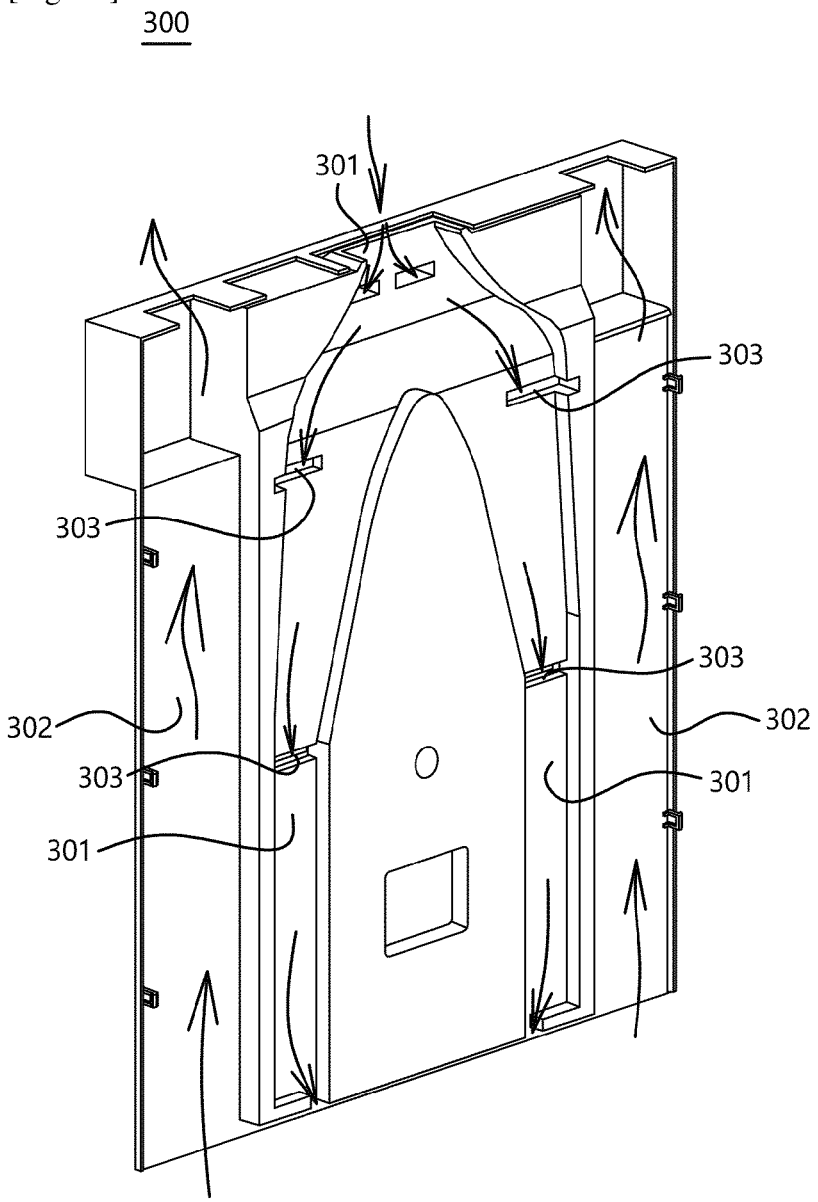

[Fig. 31]
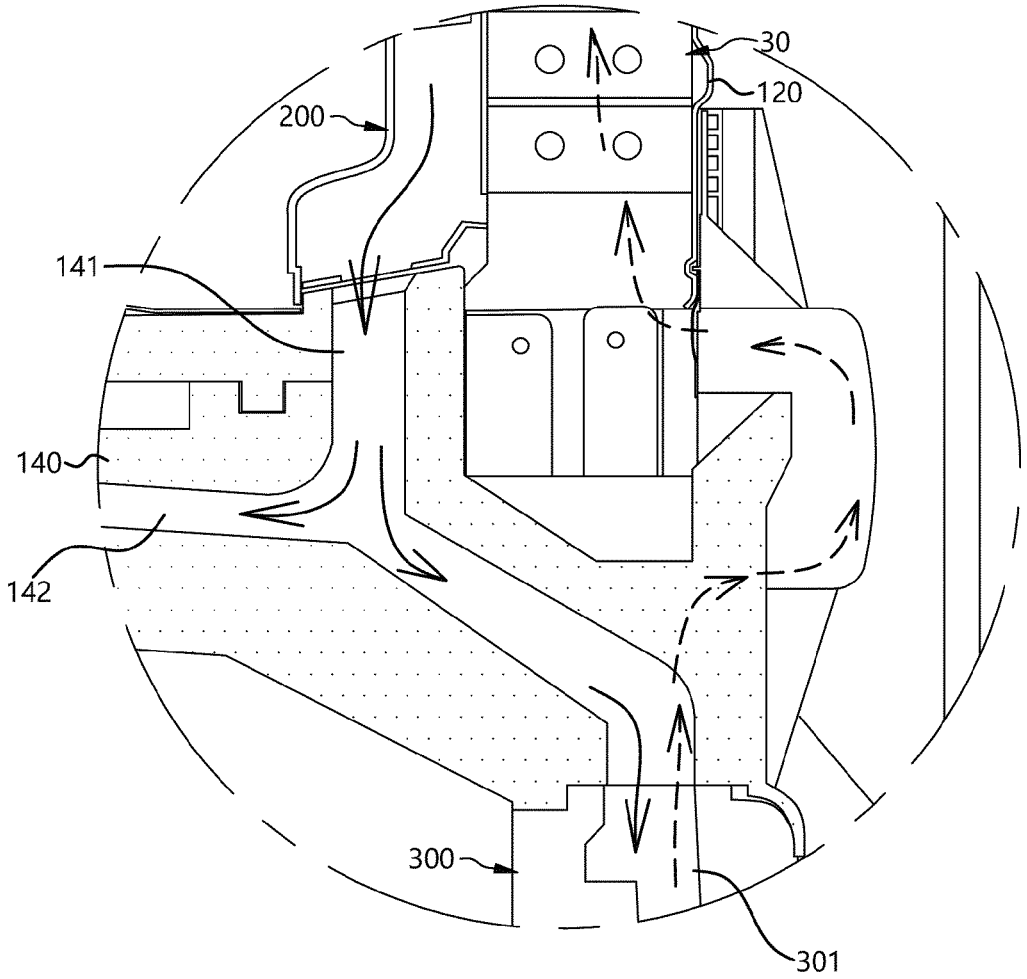

REFRIGERATOR

CROSS-REFERENCE TO RELATED APPLICATIONS

This application is a National Stage application under 35 U.S.C. § 371 of International Application No. PCT/KR2021/015136, filed on Oct. 26, 2021, which claims the benefit of Korean Patent Application No. 10-2020-0172259, filed on Dec. 10, 2020. The disclosures of the prior applications are incorporated by reference in their entirety.

TECHNICAL FIELD

The present disclosure relates to a refrigerator which has a door cooling structure in which cold air circulating after being recovered from the inside of a refrigerating compartment can be supplied to each storage compartment of a door.

BACKGROUND ART

In general, a refrigerator is a home appliance that is provided to store various foods or beverages for a long time with cold air generated by using the circulation of a refrigerant according to a refrigeration cycle.

Such a refrigerator may be classified into a top freezer refrigerator in which a freezer compartment is disposed above a refrigerating compartment, a bottom freezer refrigerator in which the freezer compartment is disposed below the refrigerating compartment, and a side by side refrigerator in which the refrigerating compartment and the freezer compartment are located by being partitioned side by side.

In the case of the top freezer refrigerator, an evaporator is located in the rear space of the inside of the freezer compartment, and a grille fan assembly in which a blower fan for supplying and circulating cold air is installed is provided in front of the evaporator.

A refrigerating compartment flow guide is formed in the grille fan assembly so as to guide cold air blown by the blower fan after passing through the evaporator such that some of the cold air is supplied to the refrigerating compartment, and the cold air guided to the refrigerating compartment flow guide is supplied to the refrigerating compartment through a communication flow path located in a partition wall separating the refrigerating compartment from the freezer compartment.

Meanwhile, the conventional refrigerator described above has a plurality of baskets provided in the inner wall surface of a door opening/closing the refrigerating compartment so as to provide more storage space.

Accordingly, in the prior art, various efforts have been made to efficiently supply cold air even to storage items stored in the baskets of the door For example, as disclosed in Korean Patent Application Publication Nos. 10-2003-0041593, 10-2003-0051092, 10-2003-0052103, 10-2005-0077556, and 10-2017-0006995, an air—blowing force is increased such that cold air can be supplied to the baskets of a door, separate flow paths are formed in a door such that cold air can be supplied to each basket, or flow paths are formed in a partition wall separating a freezer compartment from a refrigerating compartment such that cold air can be supplied to each basket.

However, the method of supplying cold air to baskets by increasing an air—blowing force increases power consumption.

In addition, in the method of supplying cold air to each basket by forming flow paths in the door, the door is a part which operates, and accordingly, a structure of preventing the leakage of cold air which may occur while supplying cold air to such a door is required to be added.

Additionally, in consideration that the door is a part to which external impact is often applied, the flow paths may be damaged due to such an impact, and the flow paths are very adjacent to outside air (indoors), so the outside air affects the temperature of cold air flowing along the flow paths.

Furthermore, in the method of supplying cold air to baskets by forming flow paths in the partition wall, the cold air is supplied downward from the upper side, and thus cold air is not efficiently supplied to a basket located at the lower side among the baskets installed in a plurality of layers on a door.

DISCLOSURE

Technical Problem

Accordingly, the present disclosure has been made to solve the above problems occurring in the related art, and the present disclosure is intended to propose a refrigerator in which cold air can be sufficiently supplied to the front space of the inside of a refrigerating compartment.

The present disclosure is intended to propose a refrigerator in which a cold air duct for door cooling provided to supply cold air to the front space of the inside of the refrigerating compartment is spaced as far apart as possible from a part at which a hot line is located such that heat loss and power consumption due to the heat loss can be reduced.

The present disclosure is intended to propose a refrigerator in which the cold air duct for door cooling provided to supply cold air to the front space of the inside of the refrigerating compartment is spaced as far apart as possible from an outer casing such that heat loss and power consumption due to the heat loss can be reduced.

Technical Solution

In order to achieve the above objectives, in the refrigerator of the present disclosure, a cold air duct for door cooling may include a main flow part located at a position farther from a hot line than a cold air discharge hole, and a branching flow part branching from the main flow part and connected to the cold air discharge hole. Accordingly, the main flow part may be spaced as far apart as possible from the hot line such that heat loss is prevented.

In the refrigerator of the present disclosure, the hot line may be installed along the perimeter of the front end of a refrigerating compartment inner casing.

In the refrigerator of the present disclosure, the cold air discharge hole may be located toward at least one portion of the upper and lower sides of a door basket provided in a refrigerating compartment door.

In the refrigerator of the present disclosure, the cold air discharge hole may include at least two cold air discharge holes, and the two cold air discharge holes may be located to be spaced vertically apart from each other.

In the refrigerator of the present disclosure, the branching flow part may include a plurality of branching flow parts, and the branching flow parts may be configured to branch from the main flow part to be connected to the cold air discharge holes, respectively.

In the refrigerator of the present disclosure, an extension part may be formed on the front end portion of the refrigerating compartment inner casing, and the cold air discharge hole may be formed in the extension part.

In the refrigerator of the present disclosure, the main flow part may be installed on a portion of the outer wall surface of the refrigerating compartment inner casing on which the extension part is not formed.

In the refrigerator of the present disclosure, the main flow part may be installed by avoiding the extension part of the outer wall surface of the refrigerating compartment inner casing.

In the refrigerator of the present disclosure, the main flow part may be located to be adjacent to the extension part and may be configured vertically.

In the refrigerator of the present disclosure, the branching flow part may be configured to be bent or be round to have the same inclination as the inclination of the extension part gradually toward the connection portion of the branching flow part with the cold air discharge hole from the main flow part.

In the refrigerator of the present disclosure, the cold air duct for door cooling may be connected to a side surface of a partition wall.

In the refrigerator of the present disclosure, a duct connection flow path may be formed in the partition wall so as to receive cold air supplied from a freezer compartment grille assembly and to supply the cold air to the connection portion of the duct connection flow path with the cold air duct for door cooling.

In the refrigerator of the present disclosure, a transferring flow path may be formed vertically through the partition wall so as to transfer cold a it supplied from the freezer compartment grille assembly to a refrigerating compartment grille assembly.

In the refrigerator of the present disclosure, the duct connection flow path may be configured to branch from the transferring flow path.

In the refrigerator of the present disclosure, a front discharge hole may be formed in the front upper surface of the refrigerating compartment inner casing such that cold air flowing through a discharge hole connection flow path is discharged through the front discharge hole.

In the refrigerator of the present disclosure, the discharge hole connection flow path may be configured to branch from the transferring flow path.

In the refrigerator of the present disclosure, a coupling plate covering the cold air discharge hole may be provided on the inner wall surface of the refrigerating compartment inner casing.

In the refrigerator of the present disclosure, the cold air duct for door cooling may be coupled to the coupling plate.

In the refrigerator of the present disclosure, a holding hook may be formed on the coupling plate, the holding hook configured to pass through the cold air discharge hole and to protrude to the outside of the refrigerating compartment inner casing.

In the refrigerator of the present disclosure, a coupling hole to which the holding hook is coupled may be formed through the cold air duct for door cooling.

In the refrigerator of the present disclosure, the cold air duct for door cooling may include a first duct constituting a wall surface of a side opposite to the refrigerating compartment inner casing and having a flow path formed on the outer surface of the first duct.

In the refrigerator of the present disclosure may include a second duct covering the outer surface of the first duct.

In the refrigerator of the present disclosure, the edges of the first duct and the second duct may be configured to be engaged with each other.

In the refrigerator of the present disclosure, the first duct and the second duct may be configured to be hooked to each other.

In the refrigerator of the present disclosure, a close-contact flange may be provided on the outer surface of the end of the first duct, the close-contact flange being configured to be open to correspond to the cold air discharge hole and being in close contact with the outer wall surface of the refrigerating compartment inner casing.

In the refrigerator of the present disclosure, a flow guide jaw may be formed on the inner surface of the end of the branching flow part of formed in the second duct, the flow guide jaw guiding the cold air flowing along a flow path between the first duct and the second duct such that the cold air is directed to the cold air discharge hole.

In the refrigerator of the present disclosure, the flow guide jaw may be configured to be round along the circumferential direction of the inside of the end of the branching flow part formed in the second duct.

In the refrigerator of the present disclosure, the flow guide jaw may be configured to be located between the center of the cold air discharge hole and the inner end surface of the branching flow part.

In the refrigerator of the present disclosure, the flow guide jaw may be configured to be inclined outward gradually in a radial direction from the center of the cold air discharge hole.

Advantageous Effects

As described above, in the refrigerator of the present disclosure, the cold air duct for door cooling may be provided, thereby efficiently performing the cooling of the door basket of the refrigerating compartment door.

Particularly, cold air may be supplied downward from the front upper surface of the inside of the refrigerating compartment and may be supplied from any one side surface of the inside of the refrigerating compartment toward another side surface thereof, thereby supplying the sufficient amount of cold air to the front space of the inside of the refrigerating compartment.

In the refrigerator of the present disclosure, the cold air duct for door cooling may be disposed to be spaced as far apart as possible from the position of the hot line, thereby reducing heat loss due to the hot line and power consumption due to the heat loss.

In the refrigerator of the present disclosure, the cold air duct for door cooling may be disposed to be spaced as far apart as possible from an outer casing, thereby reducing heat loss due to heat conducted from the outer casing and power consumption due to the heat loss.

DESCRIPTION OF DRAWINGS

FIG. 1 is a front view illustrating a refrigerator according to the embodiment of the present disclosure.

FIG. 2 is an exploded perspective view illustrating the pre-installation state of each grille assembly of the refrigerator according to the embodiment of the present disclosure.

FIG. 3 is a front view illustrating the inner state of the refrigerator according to the embodiment of the present disclosure.

FIG. 4 is a sectional view taken along line I-I of FIG. 3.

FIG. 5 is an enlarged view of an "A" part of FIG. 4.

FIGS. 6 and 7 are sectional views of an important part in which different portions are sectioned to describe the inner structure of a partition wall of the refrigerator according to the embodiment of the present disclosure.

FIG. 8 is a bottom view illustrating the shape of the lower surface of the middle layer of the partition wall constituting the refrigerator according to the embodiment of the present disclosure.

FIG. 9 is a combined perspective view illustrating a refrigerating compartment grille assembly of the refrigerator according to the embodiment of the present disclosure.

FIG. 10 is a rear perspective view illustrating the structures of a dis charge flow path and a recovery flow path formed in the refrigerating compartment grille assembly of the refrigerator according to the embodiment of the present disclosure.

FIG. 11 is a side view of a cold air duct for door cooling of a state in which an outer casing is removed to describe the installation state of the cold air duct of the refrigerator according to the embodiment of the present disclosure.

FIG. 12 is a side perspective view of the cold air duct for door cooling of the state in which the outer casing is removed to describe the installation state of the cold air duct of the refrigerator according to the embodiment of the present disclosure.

FIG. 13 is a top plan view of a state in which the cold air duct for door cooling of the refrigerator according to the embodiment of the present disclosure is mounted to a refrigerating compartment inner casing.

FIG. 14 is an enlarged view of a "B" part of FIG. 13.

FIG. 15 is an exploded perspective view illustrating the cold air duct for door cooling of the refrigerator according to the embodiment of the present disclosure.

FIG. 16 is a combined perspective view illustrating the cold air duct for door cooling of the refrigerator according to the embodiment of the present disclosure.

FIG. 17 is a top plan view illustrating the section of a portion of a main flow part to describe the cold air duct for door cooling of the refrigerator according to the embodiment of the present disclosure.

FIG. 18 is a top plan view illustrated by cutting a portion of the cold air duct for door cooling to describe the installation state of the cold air duct of the refrigerator according to the embodiment of the present disclosure.

FIG. 19 is an enlarged view of a "C" part of FIG. 18.

FIG. 20 is a side sectional view illustrated by cutting a portion of the cold air duct for door cooling to describe the installation state of the cold air duct of the refrigerator according to the embodiment of the present disclosure.

FIG. 21 is an enlarged view of a "D" part of FIG. 20.

FIG. 22 is an enlarged view of an "E" part of FIG. 20.

FIG. 23 is a plane side cross section of an important part illustrating the installation state of the cold air duct by cutting a portion of the cold air duct of the refrigerator according to the embodiment of the present disclosure.

FIG. 24 is an enlarged view of an "F" part of FIG. 23.

FIG. 25 is a view illustrating the structure of the cold air discharge side of a branching flow part in the cold air duct for door cooling of the refrigerator according to the embodiment of the present disclosure.

FIG. 26 is a view illustrating a state in which the cold air duct for door cooling is mounted to a cold air discharge hole of the refrigerating compartment inner casing of the refrigerator according to the embodiment of the present disclosure.

FIG. 27 is a side view illustrating the circulation state of cold air in a freezer compartment of the refrigerator according to the embodiment of the present disclosure.

FIG. 28 is a side view illustrating the circulation state of cold air in the refrigerating compartment of the refrigerator according to the embodiment of the present disclosure.

FIG. 29 is a cross sectional view of an important part illustrating a state in which cold air passing through the cold air duct for door cooling of the refrigerator according to the embodiment of the present disclosure is sup plied to the refrigerating compartment.

FIG. 30 is a perspective view illustrating the circulation state of cold air of the inside of the refrigerating compartment grille assembly of the refrigerator according to the embodiment of the present disclosure.

FIG. 31 is a sectional view of an important part illustrating the circulation state of cold air of the inside of the refrigerating compartment grille assembly of the refrigerator according to the embodiment of the present disclosure.

MODE FOR INVENTION

Hereinafter, an exemplary embodiment of the refrigerator of the present disclosure will be described with reference to FIGS. 1 to 31.

FIG. 1 is a front view illustrating the refrigerator according to the embodiment of the present disclosure, FIG. 2 is an exploded perspective view illustrating the pre-installation state of each grille assembly of the refrigerator according to the embodiment of the present disclosure, FIG. 3 is a front view illustrating the inner state of the refrigerator according to the embodiment of the present disclosure.

As illustrated in these drawings, the refrigerator according to the embodiment of the present disclosure may include a cabinet 100, an evaporator 30, a freezer compartment grille assembly 200, a refrigerating compartment grille assembly 300, a freezer compartment door 11, a refrigerating compartment door 21, and a cold air duct 400 for door cooling. Particularly, the cold air duct 400 for door cooling may be located to be spaced as far apart as possible from a hot line such that heat loss and power consumption due to the heat loss can be reduced.

This will be described in more detail as follows.

First, the refrigerator according to the embodiment of the present disclosure may include the cabinet 100.

The cabinet 100 may include an outer casing 110 constituting the exterior of the cabinet 100, an inner casing 120 and 130 located in the outer casing 110 and defining storage space, and a partition wall 140 separating storage compartments 10 and 20 from each other.

The inner casing 120 and 130 may include a freezer compartment inner casing 120 constituting a freezer compartment 10 and a refrigerating compartment inner casing 130 constituting the refrigerating compartment 20.

The refrigerating compartment inner casing 130 may be located under the freezer compartment inner casing 120, and the partition wall 140 may be located between the freezer compartment inner casing 120 and the refrigerating compartment inner casing 130.

The upper end of the partition wall 140 may be configured to cover the lower end of the freezer compartment inner casing 120, and the lower end of the partition wall 140 may be configured to cover the upper end of the refrigerating compartment inner casing 130.

As illustrated in FIGS. 2 to 4 and FIG. 12, an extension part 131 may be formed on the front end portion of the refrigerating compartment inner casing 130.

The extension part 131 may be configured to expand gradually toward the front of the refrigerating compartment inner casing 130 and to gradually be adjacent to the inner wall surface of the outer casing 110. Accordingly, the opening/closing of the refrigerating compartment door 21 configured to open/close the refrigerating compartment 20 may be efficiently performed.

A cold air discharge hole 132 may be formed through any one side wall surface of the refrigerating compartment inner casing 130. Such a cold air discharge hole 132 may be a part communicating with the refrigerating compartment 20 so as to supply cold air supplied along branching flow parts 402 into the refrigerating compartment 20 when the branching flow parts 402 of the cold air duct 400 for door cooling to be described later are installed.

The cold air discharge hole 132 may be formed in the extension part 131 of the refrigerating compartment inner casing 130 such that to cold air can be sufficiently supplied to a door basket 21*a* of the refrigerating compartment door 21.

The cold air discharge hole 132 may include at least two cold air discharge holes such that the two cold air discharge holes are configured to be sp aced vertically apart from each other, and may be configured as a single opening part.

Preferably, the cold air discharge hole 132 may be located to supply cold air toward at least one portion of the upper and lower sides of the door basket 21*a* of the refrigerating compartment door 21 to be described later. That is, cold air may be supplied toward the upper or lower side of the door basket 21*a* by each of the cold air discharge holes 132.

A front discharge hole 133 thorough which cold air is discharged may be formed in the front upper surface of the refrigerating compartment inner casing 130.

Meanwhile, the hot line 150 may be installed along the perimeter of the front end of the refrigerating compartment inner casing 130.

Such a hot line 150 may function to prevent condensation on a sealing portion of the refrigerating compartment door 21 to be described later and being in close contact with the front surface of the refrigerating compartment inner casing 130, and may be configured as a hot wire or a part of a condenser through which a high-temperature refrigerant flows.

Next, the refrigerator according to the embodiment of the present disclosure may include doors 11 and 21.

The doors 11 and 21 may include the freezer compartment door 11 configured to open/close the open front surface of the freezer compartment inner casing 120 and the refrigerating compartment door 21 configured to open/close the open front surface of the refrigerating compartment inner casing 130. That is, the freezer compartment 10 constituted by the freezer compartment inner casing 120 and the refrigerating compartment 20 constituted by the refrigerating compartment inner casing 130 may be opened/closed by the doors 11 and 21, respectively.

Each of such doors 11 and 21 may be configured as a swinging door as illustrated in the drawing. Of course, although not shown, at least one door of the doors may be configured as a drawer-type door.

As illustrated in FIG. 4, in the case of the refrigerating compartment door 21 configured to open/close the refrigerating compartment 20, the door basket 21*a* may be provided on the inner surface (the inner wall surface of the refrigerator) of the refrigerating compartment door 21.

The door basket 21*a* may be a part provided to store beverages and other storage items, and may be installed on the inner wall surface (a wall surface facing the refrigerating compartment) of the refrigerating compartment door 21.

The door basket 21*a* may include a plurality of door baskets, and the door baskets may be located to be vertically spaced apart from each other while forming a plurality of layers. Of course, the door basket 21*a* may include a plurality of door baskets for each layer.

The refrigerator according to the embodiment of the present disclosure may include the evaporator 30.

The evaporator 30 may be a component provided to generate cold air to be supplied to the freezer compartment 10 or the refrigerating compartment 20.

The evaporator 30 may constitute a refrigeration system together with a compressor 60 (see FIG. 4), the condenser (not shown), and an expander (not shown), and may function to lower the temperature of the air while the air exchanges heat with air passing through the evaporator 30.

Such an evaporator 30 may be located at the rear of the inside of the freezer compartment 10. Specifically, the evaporator 30 may be located to be adjacent to the front of the rear wall surface of the inside of the freezer compartment 10.

The refrigerator according to the embodiment of the present disclosure may include the freezer compartment grille assembly 200.

The freezer compartment grille assembly 200 may be located at the rear portion of the inside of the freezer compartment inner casing 120, and the freezer compartment 10 inside the freezer compartment inner casing 120 may be divided into spaces in which a storage space and the evaporator 30 are installed at front and rear sides, respectively, of the grille assembly 200 relative to the grille assembly 200.

A blower fan 201 configured to blow cold air may be mounted to the freezer compartment grille assembly 200. In this case, the blower fan 201 may be configured as a module provided with a fan and a motor.

As illustrated in FIG. 3, a plurality of freezer compartment discharge holes 202 (see FIG. 3) may be formed in the freezer compartment grille assembly 200.

As illustrated in FIG. 3, a freezer compartment discharge flow path 203 guiding the discharging of cold air blown by the blower fan 201 to each of the freezer compartment discharge holes 202 may be formed in the freezer compartment grille assembly 200. In this case, the freezer compartment discharge flow path 203 may be formed to guide the flow of cold air to opposite upper and lower portions relative to the position of the blower fan 201, and in this case, each of the freezer compartment discharge holes 202 may be formed in the freezer compartment discharge flow path 203.

As illustrated in FIG. 3, a refrigerating compartment supplying flow path 204 may be formed in the freezer compartment grille assembly 200.

The refrigerating compartment supplying flow path 204 may be a flow path formed to supply some of cold air blown by the blower fan 201 to the refrigerating compartment grille assembly 300 and may be formed from the central portion of the grille assembly 200 at which the blower fan 201 is located to the lower surface of the freezer compartment grille assembly 200.

Although now shown in detail, a thermostat 206 (see FIGS. 3 and 4) may be provided in the refrigerating compartment supplying flow path 204, the thermostat controlling the amount of cold air flowing through the supplying flow path to control the internal temperature of the freezer compartment 10 or the refrigerating compartment 20.

A freezer compartment recovery flow path 205 may be formed in the freezer compartment grille assembly 200. The freezer compartment recovery flow path 205 may be formed in the lower surface of the freezer compartment grille assembly 200 by being recessed therefrom, and in this case, the front end of the freezer compartment recovery flow path 205 may be configured to be exposed to the inside of the freezer compartment 10 and the rear end of the recovery flow path 205 may be configured to be exposed to the lower part of the evaporator 30.

That is, cold air flowing through the inside of the freezer compartment 10 may be recovered to the cold air introduction part of the evaporator 30 through the freezer compartment recovery flow path 205.

Meanwhile, as illustrated in FIGS. 5 to 7, a transferring flow path 141 may be formed on the partition wall 140, transferring flow path 141 being configured to receive cold air from the freezer compartment grille assembly 200 and to supply the cold air to the refrigerating compartment discharge flow path 301 of the refrigerating compartment grille assembly 300.

The transferring flow path 141 may be formed vertically through the central portion of the rear side of the partition wall 140. Specifically, the upper end of the transferring flow path 141 may correspond to the refrigerating compartment supplying flow path 204 of the freezer compartment grille assembly 200, and the lower end of the transferring flow path 141 may correspond to the refrigerating compartment discharge flow path 301 of the refrigerating compartment grille assembly 300.

As illustrated in FIG. 8, a discharge hole connection flow path 142 may be formed in the partition wall 140.

The discharge hole connection flow path 142 may branch from the transferring flow path 141 and extend to the front discharge hole 133 located at the front lower surface of the partition wall 140, and may supply cold air to the front space of the inside of the refrigerating compartment 20.

As illustrated in FIG. 8, a duct connection flow path 143 may be formed in the partition wall 140.

The duct connection flow path 143 may branch from the transferring flow path 141 and may be configured to pass through any one side surface of the partition wall 140. Such a duct connection flow path 143 may be connected to the cold air duct 400 for door cooling to be described later and may function to transfer cold air.

The partition wall 140 may be configured to form a single wall by being divided into a plurality of layers and laminating the layers to each other (see FIGS. 4 to 7), and each flow path formed in the partition wall 140 may be formed in at least one surface of opposing surfaces to each other between the layers of the partition wall by being recessed therefrom.

For example, the discharge hole connection flow path 142 and the duct connection flow path 143 may be formed between the bottom surface of a middle layer constituting the partition wall 140 and the upper surface of the lowest layer, and the upper surface of the middle layer constituting the partition wall 140 and the bottom surface of a top layer thereof. In FIG. 8, for an ex ample, each of the flow paths is illustrated to be formed on the bottom surface of the middle layer constituting the partition wall 140 by being recessed therefrom.

The refrigerator according to the embodiment of the present disclosure may include the refrigerating compartment grille assembly 300.

The refrigerating compartment grille assembly 300 may be configured to guide the discharging of cold air transferred from the freezer compartment gr ille assembly 200 through the transferring flow path 141 of the partition wall 140 to the inside of the refrigerating compartment 20.

The refrigerating compartment grille assembly 300 may be located at the rear portion of the inside of the refrigerating compartment 20. Specifically, the grille assembly 300 may be located in front of the rear wall surface of the inside of the refrigerating compartment inner casing 130.

As illustrated in FIGS. 9 and 10, the refrigerating compartment discharge flow path 301 may be formed in the refrigerating compartment grille assembly 300, the discharge flow path 301 guiding the discharging of cold air supplied from the freezer compartment grille assembly 200 to the inside of the refrigerating compartment 20.

A refrigerating compartment recovery flow path 302 may be formed in the refrigerating compartment grille assembly 300, the recovery flow path 302 guiding the flow of cold air recovered from the refrigerating compartment 20 to the freezer compartment 10.

Here, the refrigerating compartment discharge flow path 301 may be formed along the center portion of the refrigerating compartment grille assembly 300, and the refrigerating compartment recovery flow path 302 may be formed along the opposite side portions of the refrigerating compartment grille assembly 300. In this case, the refrigerating compartment recovery flow path 302 may be configured to be open to the lower surface of the refrigerating compartment grille assembly 300 such that cold air flowing through the inside of the refrigerating compartment 20 is recovered to the refrigerating compartment recovery flow path 302 through an open portion formed in the lower surface of the refrigerating compartment grille assembly 300.

A plurality of refrigerating compartment discharge holes 303 may be formed in the refrigerating compartment grille assembly 300, and the refrigerating compartment discharge flow path 301 may be configured to pass a portion in which each of the refrigerating compartment discharge holes 303 is formed. Accordingly, cold air flowing along the refrigerating compartment discharge flow path 301 may be discharged to the refrigerating compartment 20 through each of the refrigerating compartment discharge holes 303.

The refrigerator according to the embodiment of the present disclosure may include the cold air duct 400 for door cooling.

The cold air duct 400 for door cooling is a duct through which cold air supplied from the freezer compartment grille assembly 200 is received and supplied to the front space of the inside of the refrigerating compartment 20 through the cold air discharge hole 132.

As illustrated in FIGS. 10 to 14, such a cold air duct 400 for door coo ling is located in the outer wall surface of any one side of the refrigerating compartment inner casing 130. Specifically, the cold air duct 400 for door cooling may be located at a wall surface of the same side as a side surface through which the duct connection flow path 143 formed in the partition wall 140 passes.

The upper end of the cold air duct 400 for door cooling may be connected to the duct connection flow path 143, and the lower end of the cold air duct 400 for door cooling may be connected to the cold air discharge hole 132 formed in the refrigerating compartment inner casing 130.

In the embodiment of the present disclosure, the cold air duct 400 for door cooling may be configured to be spaced as far apart as possible from the hot line 150 or the outer casing 110 to prevent heat loss which may be caused when the cold air duct 400 is adjacent to the hot line 150 or the outer casing 110.

The structure of such a cold air duct 400 for door cooling will be described further in detail for each configuration thereof with reference to FIGS. 11 to 26.

As illustrated in FIGS. 11 and 12, the cold air duct 400 for door cooling according to the embodiment of the present disclosure may include a main flow part 401 and the branching flow parts 402.

The main flow part 401 may be connected to the duct connection flow path 143 and receive cold air from the duct connection flow path 143 such that the cold air is transferred to each of the branching flow parts 402.

As illustrated in FIGS. 13 and 14, such a main flow part 401 may be ins tailed at a position farther from the hot line 150 than the cold air discharge hole 132.

The main flow part 401 may be installed on a portion of the outer wall surface of the inner casing 130 on which the extension part 131 is not formed The main flow part 401 may be located to be adjacent to the extension part 131 and may be configured vertically. Accordingly, the main flow part 401 is not affected by the hot line 150, so the heat loss of cold air flowing along the main flow part 401 can be prevented.

The branching flow part 402 may branch from the main flow part 401 and may be connected to the cold air discharge hole 132. In this case, the branching flow part 402 may include a plurality of branching flow parts.

The branching flow part 402 may be configured to be inclined downward gradually toward the connection portion of the branching flow part 402 with the cold air discharge hole 132 from the connection portion of the branching flow part 402 with the main flow part 401. Accordingly, cold air flowing along the main flow part 401 may efficiently flow to each of the branching flow parts 402.

Each of the branching flow parts 402 may be configured to be bent or round outward to have the same inclination as the extension part 131 gradually toward a front which is the connection portion of the branching flow part 402 with the cold air discharge hole 132 from the main flow part 401.

That is, the main flow part 401 may be located to be adjacent to the outer wall surface of the refrigerating compartment inner casing 130 as much as possible. Accordingly distance between the main flow part 401 and the outer casing 110 may be secured as much as possible such that the rise of the temperature of the main flow part due to indoor heat conducted from the outer casing 110 is prevented (or minimized).

Meanwhile, as illustrated in FIGS. 14 to 17, the cold air duct 400 for door cooling may be configured as a single tube, but is configured to be divided into a first duct 410 and a second duct 420 for the ease of manufacturing and the diversification of shapes.

That is, the first duct 410 and the second duct 420 are coupled to each other such that the cold air duct 400 for door cooling having the main flow part 401 and each of the branching flow parts 402 is formed.

The first duct 410 may form a wall surface opposite to the refrigerating compartment inner casing 130 and may be configured to include a flow path formed in an outer surface (a surface opposite to the second duct) of the first duct 410. The second duct 420 may be configured to cover the outer surface of the first duct 410 and may be configured to include a flow path on a surface opposite to the first duct 41. That is, due to the coupling of the first duct 410 to the second duct 420, a flow path may be formed therein.

In this case, the edges of the first duct 410 and the second duct 420 may be configured to be engaged with each other and may be configured to be hooked to each other. These engagement and hooking structures are configured in consideration that during the releasing of foaming liquid filled in space between the outer casing 110 and the refrigerating compartment inner casing 130, a gap may occur in a contact portion between the two ducts 410 and 420 due to the releasing pressure of the foaming liquid.

Of course, the two ducts 410 and 420 may be coupled to each other only by being engaged with each other, and the two ducts 410 and 420 may be coupled to each other only by being hooked to each other, and may be coupled to each other in various manners such as screwing and bonding.

A connection tube 413 may be formed on the upper end of the main flow part 401 formed in the first duct 410 by protruding therefrom, the connection tube being connected to the duct connection flow path 143 of the partition wall 140 (see FIG. 16). In this case, the connection tube 413 may be configured to be inserted into and coupled to the duct connection flow path 143.

A through hole 411 corresponding to the cold air discharge hole 132 may be formed in the outer surface of the end of the branching flow part 402 formed on the first duct 410, and the close—contact flange 412 may be provided on the circumference of the through hole 411, the close—contact flange being in close contact with the outer wall surface of the refrigerating compartment inner casing 130.

That is, due to the provision of the close—contact flange 412, the first duct 410 may be combined airtightly at a precise position.

Meanwhile, corrugations may be formed on the surfaces of the first duct 410 and the second duct 420 described above so as to prevent the bending deformation of the cold air duct 400 for door cooling.

As illustrated in FIGS. 18 to 26, a flow guide jaw 421 may be formed on the inner surface of the end of each of the branching flow parts 402 formed in the second duct 420, the flow guide jaw guiding the flow of cold air flowing along a flow path between the first duct 410 and the second duct 420 toward the cold air discharge hole 132.

That is, a direction in which the cold air discharge hole 132 is formed may be perpendicular to the flowing direction of cold air flowing along the branching flow part 402, so turbulence may occur in the process of passing through the cold air discharge hole 132 after passing the end of the branching flow part 402. In consideration of this, the flow guide jaw 421 may be provided to prevent the occurrence of the turbulence and to efficiently discharge cold air in a direction toward the cold air discharge hole 132.

Such a flow guide jaw 421 may be configured to be located between the center (the center of a portion opposite to the cold air discharge hole) of a coupling hole 422 formed in the end portion of the inside of the branching flow part 402 of the second duct 420 and the inner end surface of the branching flow part 402. Accordingly, cold air flowing along the branching flow part 402 may be guided by the flow guide jaw 421 when reaching the end of the branching flow part 402.

The flow guide jaw 421 may be configured to be round along the circumference of the end of the inside of the branching flow part 402. Particularly, the flow guide jaw 421 may be configured to be inclined outward gradually in a radial direction from the center of the coupling hole 422 (or the center of the cold air discharge hole). Accordingly, cold air flowing along the branching flow part 402 may be guided by the flow guide jaw 421 to be efficiently discharged toward the inside of the refrigerating compartment 20.

As illustrated in FIG. 15 and FIGS. 18 to 24, in the inner wall surface of the refrigerating compartment inner casing 130, a portion in which the cold air discharge hole 132 is formed may be provided with a coupling plate 160

That is, the coupling plate 160 may be provided such that the end of the cold air duct 400 for door cooling can be fastened to the refrigerating compartment inner casing 130.

In this case, a seating groove 134 may be formed in the inner wall surface of the refrigerating compartment inner casing 130 by being recessed there from, and the coupling plate 160 may be installed to be seated in the seating groove 134.

A holding hook 161 sequentially passing through the cold air discharge hole 132 and the through hole 411 of the first duct 410 may be formed in the coupling plate 160, and the coupling hole 422 to which the holding hook 161 is coupled may be formed in the end portion of the inside of each of the branching flow parts 402 corresponding to the through hole 411 in each portion of the second duct 420 constituting the cold air duct 400 for door cooling. Accordingly, the cold air duct 400 for door cooling may be mounted to the coupling plate 160.

A plurality of discharge holes 162 may be formed in the perimeter of the portion of the coupling plate 160 in which the holding hook 161 is formed, so cold air supplied through each of the branching flow parts 402 constituting the cold air duct 400 for door cooling may be discharged into the refrigerating compartment 20.

Holding jaws 163 may be formed on the lower end of the coupling plate 160 by bending therefrom, and thus the coupling plate 160 may be configured to be seated in the seating groove 134 of the refrigerating compartment inner casing 130 so as not to be removed therefrom. In this case, the holding jaws 163 may be configured to cover the inner and outer surfaces of the inner casing 130. This is illustrated in FIG. 22.

The process of the supply and recovery of cold air of the refrigerator according to the embodiment of the present disclosure described above will be described further in detail with reference to FIGS. 27 to 31.

In the refrigerator, the compressor 60 and the blower fan 201 constituting a refrigeration cycle may operate according to the internal temperature condition of the freezer compartment 10 or the refrigerating compartment 20.

That is, when the temperature of the inside of the freezer compartment 10 or the refrigerating compartment 20 reaches a dissatisfaction zone (the zone of temperature higher than preset temperature), the compressor 60 may operate and the flow of a refrigerant which sequentially passes through the condenser, the expander, and the evaporator 30 may be performed, and at the same time, the blower fan 201 may operate, and cold air heat exchanged while passing through the evaporator 30 may be supplied to the freezer compartment 10 and the refrigerating compartment 20 through the grille assembly 200.

In this case, cold air recovered from the freezer compartment 10 or the refrigerating compartment 20 by the operation of the blower fan 201 may pass through the evaporator 30, and in this process, the cold air passing through the evaporator 30 may lose moisture and may be heat exchanged to have a lower temperature.

The cold air passing through the evaporator 30 may pass through the blower fan 201 and then may be introduced into the freezer compartment grille assembly 200.

Continuously, the cold air introduced into the freezer compartment grille assembly 200 may pass through each of the freezer compartment discharge holes 202 formed in the freezer compartment grille assembly 200 to be supplied into the freezer compartment 10 while flowing along the freezer compartment discharge flow path 203 formed in the freezer compartment grille assembly 200.

Accordingly, items stored in the freezer compartment 10 may be stored frozen by cold air.

Furthermore, after cold air supplied into the freezer compartment 10 circulates in the freezer compartment 10, the cold air may pass through the freezer compartment recovery flow path 205 formed in the lower surface of the freezer compartment grille assembly 200 and may be recovered to the cold air introduction part of the evaporator 30, and then may pass through the evaporator 30 again to be repeatedly circulated for heat exchange. This is illustrated in FIG. 27.

Meanwhile, some of cold air introduced into the freezer compartment grille assembly 200 may flow through the refrigerating compartment supplying flow path 204 formed in the freezer compartment grille assembly 200 and may be supplied to the transferring flow path 141 formed in the partition wall 140.

Continuously, the cold air supplied to the transferring flow path 141 may be supplied to the discharge flow path 301 of the grille assembly 300 to which the transferring flow path 141 is connected.

Accordingly, the cold air may flow along the refrigerating compartment discharge flow path 301 and may be supplied to the refrigerating compartment through each of the refrigerating compartment discharge holes 303 formed in the discharge flow path.

Some of cold air flowing along the transferring flow path 141 may be supplied to each of the discharge hole connection flow path 142 and the duct connection flow path 143 branching from the transferring flow path 141.

In this case, cold air flowing along the discharge hole connection flow path 142 may pass through the front lower surface of the partition wall 140 and may be supplied to the front space of the inside of the refrigerating compartment 20 through the front discharge hole 133 of the refrigerating compartment inner casing 130. This is illustrated in FIG. 28.

Cold air flowing along the duct connection flow path 143 may be supplied to the cold air duct 400 connected to the duct connection flow path 143.

Continuously, the cold air supplied to the cold air duct 400 for door cooling may flow along the main flow part 401 of the cold air duct 400 for door cooling and may be supplied to each of the branching flow parts 402, and then may be supplied through the cold air discharge hole 132 formed in the refrigerating compartment inner casing 130 to the front space of the inside of the refrigerating compartment 20. This is illustrated in FIG. 29.

In this case, cold air supplied into the front space of the inside of the refrigerating compartment 20 through the front discharge hole 133 may be discharged in a downward direction from the upper side of the refrigerating compartment, and cold air supplied to the front space of the inside of the refrigerating compartment 20 through the cold air discharge hole 132 may be discharged from any one side portion to another side portion.

Accordingly, although the refrigerating compartment grille assembly 300 is located in the rear space of the inside of the refrigerating compartment 20, sufficient cold air may be supplied even to the front space of the inside of the refrigerating compartment 20. That is, sufficient cold air is supplied to the door basket 21*a* of the refrigerating compartment door 21, so the st able refrigeration storage of items stored in the door basket 21*a* is possible Particularly, in the case of the cold air duct 400 for door cooling, the main flow part 401 may be configured to be as apart as possible from the hot line 150 and the outer casing 110, and only the end of each of the branching flow parts 402 may be adjacent to the hot line 150 and the outer casing 110, so the cold air duct 400 for door cooling may minimize the occurrence of heat loss due to heat conducted from the hot line 150 or the outer casing 110.

As described above, cold air flowing in the refrigerating compartment 20 may be recovered to the refrigerating compartment recovery flow path 302 through an open portion formed in each of the opposite sides of the lower surface of the refrigerating compartment grille assembly 300. This is illustrated in FIG. 30.

Continuously, the cold air recovered to the refrigerating compartment recovery flow path 302 may flow to the cold air introduction part of the evaporator 30, and then may pass through the evaporator 30 again to be repeatedly circulated for heat exchange. This is illustrated in FIG. 31.

When the internal temperature of the refrigerating compartment 20 belongs to a satisfaction zone (the satisfaction of a preset temperature) while cold air is supplied to the refrigerating compartment 20 by each process described above, the operations of the blower fan 201 and the compressor 60 may stop. Of course, when the internal temperatures of the refrigerating compartment 20 and the freezer compartment 10 are satisfied, the blower fan 201 and the compressor 60 may be controlled to stop operating.

After all, in the refrigerator of the present disclosure, the cold air duct 400 for door cooling may be provided, thereby efficiently performing the cooling of the door basket 21*a* of the refrigerating compartment door 21.

Cold air may be supplied downward from the front upper surface of the inside of the refrigerating compartment 20 and may be supplied from any one side surface of the inside of the refrigerating compartment 20 toward another side surface thereof, thereby supplying the sufficient amount of cold air to the front space of the inside of the refrigerating compartment 20.

In the refrigerator of the present disclosure, the cold air duct for door cooling may be disposed to be spaced as far apart as possible from the position of the hot line, thereby reducing heat loss due to the hot line and power consumption due to the heat loss.

In the refrigerator of the present disclosure, the cold air duct for door cooling may be disposed to be spaced as far apart as possible from the outer casing, thereby reducing heat loss due to heat conducted from the outer casing and power consumption due to the heat loss.

The invention claimed is:

1. A refrigerator comprising:

an outer casing that defines an exterior of the refrigerator;

a partition wall that divides an inner space of the outer casing into an upper space and a lower space;

a freezer compartment inner casing that is located in the upper space above the partition wall and defines a freezer compartment;

a refrigerating compartment inner casing that is located in the lower space below the partition wall and defines a refrigerating compartment, the refrigerating compartment inner casing having a side wall that defines a cold air discharge hole;

an evaporator located in the freezer compartment inner casing;

a freezer compartment door to open and close the freezer compartment;

a refrigerating compartment door to open and close the refrigerating compartment;

a hot line disposed along a perimeter of a front end portion of the refrigerating compartment inner casing facing the refrigerating compartment door;

a cold air duct located between a side wall of the outer casing and the side wall of the refrigerating compartment inner casing to receive cold air supplied from the freezer compartment and to supply the cold air to a front space of the refrigerating compartment through the cold air discharge hole, wherein the partition wall having a duct connection flow path to guide the cold air provided from the freezer compartment, and the duct connection flow path configured to pass through a side surface of the partition wall, wherein the cold air duct comprises:

a main flow part located at a position farther from the hot line than from the cold air discharge hole, the cold air discharge hole being located between the main flow part and the hot line, and a branching flow part branched from the main flow part and connected to the cold air discharge hole.

2. The refrigerator of claim 1, further comprising a door basket located at the refrigerating compartment door, wherein the cold air discharge hole is oriented toward at least one of an upper side or a lower side of the door basket.

3. The refrigerator of claim 1, wherein the cold air discharge hole comprises a plurality of cold air discharge holes spaced apart from each other, and wherein the branching flow part comprises a plurality of branching flow parts that are branched from the main flow part and connected to the plurality of cold air discharge holes, respectively.

4. The refrigerator of claim 1, wherein the refrigerating compartment inner casing comprises an extension part that extends forward from the front end portion of the refrigerating compartment inner casing and is located adjacent to an inner wall surface of the outer casing, the extension part defining the cold air discharge hole.

5. The refrigerator of claim 4, wherein at least a portion of the main flow part is spaced apart from the extension part of the refrigerating compartment inner casing.

6. The refrigerator of claim 4, wherein the main flow part is located adjacent to the extension part and extends along the side wall of the refrigerating compartment inner casing.

7. The refrigerator of claim 6, wherein the extension part is inclined with respect to an inner wall surface of the refrigerating compartment inner casing, and the branching flow part is inclined with respect to the main flow part and extends to the cold air discharge hole.

8. The refrigerator of claim 1, wherein the partition wall defines a duct connection flow path to receive the cold air supplied from the freezer compartment and to supply the cold air to the cold air duct to thereby cool the refrigerating compartment door.

9. The refrigerator of claim 8, wherein the partition wall further defines a transferring flow path that extends through the partition wall to transfer the cold air supplied from the freezer compartment to the refrigerating compartment, and wherein the duct connection flow path is branched from the transferring flow path.

10. The refrigerator of claim 9, wherein the refrigerating compartment inner casing defines a front discharge hole at a front upper side thereof, and wherein the partition wall further defines a discharge hole connection flow path that is branched from the transferring flow path to transfer the cold air to the front discharge hole.

11. A refrigerator comprising:

an outer casing that defines an exterior of the refrigerator;

a partition wall that divides an inner space of the outer casing into an upper space and a lower space;

an inner casing that defines an interior of the refrigerator, the inner casing having an opening for access to the interior of the refrigerator, and a cold air discharge hole at a side of the inner casing;

a refrigerator door to open and close the opening of the inner casing;

a cold air duct located between a side wall of the outer casing and a side wall of the inner casing, the cold air duct to supply cold air to a front of the refrigerator through the cold air discharge hole;

wherein the partition wall having a duct connection flow path to guide cold air, and the duct connection flow path configured to pass through a side surface of the partition wall, and wherein the cold air duct comprises:

a main flow part including a first end and a second end opposite the first end, the main flow part located farther from the opening of the inner casing than from the cold air discharge hole, the cold air discharge hole located between the main flow part and the opening of the inner casing, and a branching flow part branching from between the first end and the second end of the main flow part and connected with the cold air discharge hole.

12. The refrigerator of claim 11, wherein the branching flow part branches at an angle from the main flow part to connect with the cold air discharge hole.

13. The refrigerator of claim 11, comprising an extension part that extends from a front side of the refrigerator toward a back side of the refrigerator, the extension part including a hot line, wherein the cold air discharge hole is located at the extension part, and at least a portion of the main flow part is located farther away from the extension part.

14. The refrigerator of claim 13, wherein the branching flow part branches across the extension part to connect with the cold air discharge hole.

15. The refrigerator of claim 13, wherein the extension part is inclined with respect to the inner casing, and the branching flow part is inclined with respect to the main flow part.

16. The refrigerator of claim 11, wherein the branching flow part includes a first branching flow part and a second branching flow part, and the cold air discharge hole includes a first cold air discharge hole and a second cold air discharge hole, the first branching flow part branching from between the first end and the second end of the main flow part and is connected with the first cold air discharge hole, and the second branching flow part branching from the second end of the main flow part and is connected with the second cold air discharge hole.

17. The refrigerator of claim 16, comprising a plurality of door baskets at the door, wherein the first cold air discharge hole and the second cold air discharge hole blow the cold air toward the plurality of door baskets.

18. The refrigerator of claim 11, wherein the cold duct is located closer to the inner casing than the outer casing.

19. The refrigerator of claim 11, comprising a partition wall including a transferring flow path at the partition wall, wherein the first end of the main flow part is connected with the transferring flow path.

20. The refrigerator of claim 19, wherein the partition wall includes a hole connection flow path branching from the transferring flow path, and the first end of the branching flow part is connected with the transferring flow path.

* * * * *